US005865483A

United States Patent [19]

Dubravin

[11] Patent Number: 5,865,483

[45] Date of Patent: Feb. 2, 1999

[54] ELECTROMECHANICAL LOCKING SYSTEM

[76] Inventor: Roman Dubravin, 75-15 182nd St., Flushing, N.Y. 11366

[21] Appl. No.: 783,447

[22] Filed: Jan. 16, 1997

[51] Int. Cl.[6] ..... E05C 17/56

[52] U.S. Cl. ..... 292/251.5; 70/92; 70/277; 70/279; 70/282; 292/92; 292/201; 292/254; 292/341.16

[58] Field of Search ..... 70/276, 277, 92, 70/279, 282; 292/251.5, 144, 92, 341.16, 254, 201

[56] References Cited

U.S. PATENT DOCUMENTS

| | | | |
|---|---|---|---|
| 2,565,891 | 8/1951 | Sherman | 292/251.5 |
| 2,691,544 | 10/1954 | Parker | 292/254 |
| 2,984,510 | 5/1961 | Hoffmann | 292/251.5 |
| 3,312,492 | 4/1967 | Remhof | 292/251.5 |
| 3,408,838 | 11/1968 | Katz | 70/277 |
| 3,518,854 | 7/1970 | Krantz | 292/254 |
| 3,521,921 | 7/1970 | Miyazaki | 292/254 |
| 3,647,165 | 3/1972 | Whitla | 292/251.5 X |
| 3,758,142 | 9/1973 | Gartner | 292/254 |
| 3,861,727 | 1/1975 | Froerup et al. | 292/341.16 |
| 4,073,518 | 2/1978 | Goodwin | 292/144 |
| 5,029,912 | 7/1991 | Gotanda | 292/251.5 X |
| 5,199,288 | 4/1993 | Meriläinen et al. | 70/279 |
| 5,228,730 | 7/1993 | Gokcebay et al. | 292/144 |
| 5,729,198 | 3/1998 | Gorman | 70/279 X |

FOREIGN PATENT DOCUMENTS

| | | | |
|---|---|---|---|
| 638691 | 3/1962 | Canada | 292/254 |
| 696676 | 10/1930 | France | 292/251.5 |
| 2693759 | 1/1994 | France | 292/251.5 |
| 525361 | 5/1955 | Italy | 292/251.5 |
| 1184 | 1/1911 | United Kingdom | 292/254 |
| 12983 | 5/1914 | United Kingdom | 292/254 |

*Primary Examiner*—Lloyd A. Gall
*Attorney, Agent, or Firm*—Richard C. Litman

[57] ABSTRACT

An electromagnetic door lock which uses an electromagnet in addition to a latch to maintain the door in the locked position. The lock has hinged handles that unlock the latch when they pivot. When the latch moves to an unlocked position it operates a reed switch which turns off the electromagnet. The latch can also be unlocked by a remotely controlled solenoid. Key operated locks allow only persons with a key to be able to move the pivoting handles.

19 Claims, 21 Drawing Sheets

ELECTROMECHANICAL LOCKING SYSTEM

BACKGROUND OF THE INVENTION

1. Field of the Invention

The present invention relates to a remotely controllable electromagnetic door lock, which uses an electromagnet in addition to a mechanical latch to maintain the door in the locked condition.

2. Introduction and Description of the Prior Art

Security concerns often times require that public access to certain buildings be limited. For example, it is desirable that access to a multi-story apartment building be limited to the tenants, their guests, and other authorized personnel. Tenants and authorized personnel can be supplied with keys. However, it would be very inconvenient for tenants to run to the front door to let their guests into the building each time they are visited by guests. Also, in government facilities it is desirable to allow only those members of the public who have legitimate business to transact within the facility, to be allowed into the facility. For this reason security guards are often used to control admission of members of the public to the facility, and the guards need to be able to allow persons into a building without having to constantly leave their stations. In the above described types of circumstances, the use of remotely operable electric door locks, operated either by tenants from within their apartments or security guards, has become widespread.

U.S. Pat. No. 5,228,730, issued to Gokcebay et al., shows an electric door lock which uses a magnetic latching solenoid to lock and unlock the door. The magnetic latching solenoid changes position in response to a momentarily applied electric current. The Gokcebay et al. device does not use an electromagnet to hold the door closed.

U.S. Pat. No. 5,199,288, issued to Meriläinen et al., shows an electric lock which uses an electric motor to move the locking bolt via a worm and gear arrangement. The Meriläinen et al. device does not use an electromagnet to hold the door closed.

U.S. Pat. No. 4,073,518, issued to Goodwin, shows an electric door lock which uses solenoids to move locking bars between locked and unlocked positions. The Goodwin device does not use an electromagnet to hold the door closed.

U.S. Pat. No. 3,408,838, issued to Katz, shows an electric door lock which uses an electromagnetic coil to move the door latch and unlock the door. The Katz device does not use an electromagnet to hold the door closed.

None of the above inventions and patents, taken either singly or in combination, is seen to describe the instant invention as claimed.

SUMMARY OF THE INVENTION

The present invention is directed to an electromagnetic door lock which uses an electromagnet in addition to a latch to maintain the door in the locked position. The lock has hinged handles that unlock the latch when they pivot. When the latch moves to an unlocked position it magnetically operates a reed switch which turns off the electromagnet. The latch can also be unlocked by a remotely controlled solenoid. Key operated cylinder locks allow only persons with a key to be able to move the pivoting handles.

Accordingly, it is a principal object of the invention to provide a door lock that uses an electromagnet to keep the door locked.

It is another object of the invention to provide a lock having an electromechanically actuated latch in addition to an electromagnet.

It is a further object of the invention to provide a lock that can be opened by persons having a key without the need for intervention from within the building.

Still another object of the invention is to provide a lock which can be remotely actuated from within the building.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
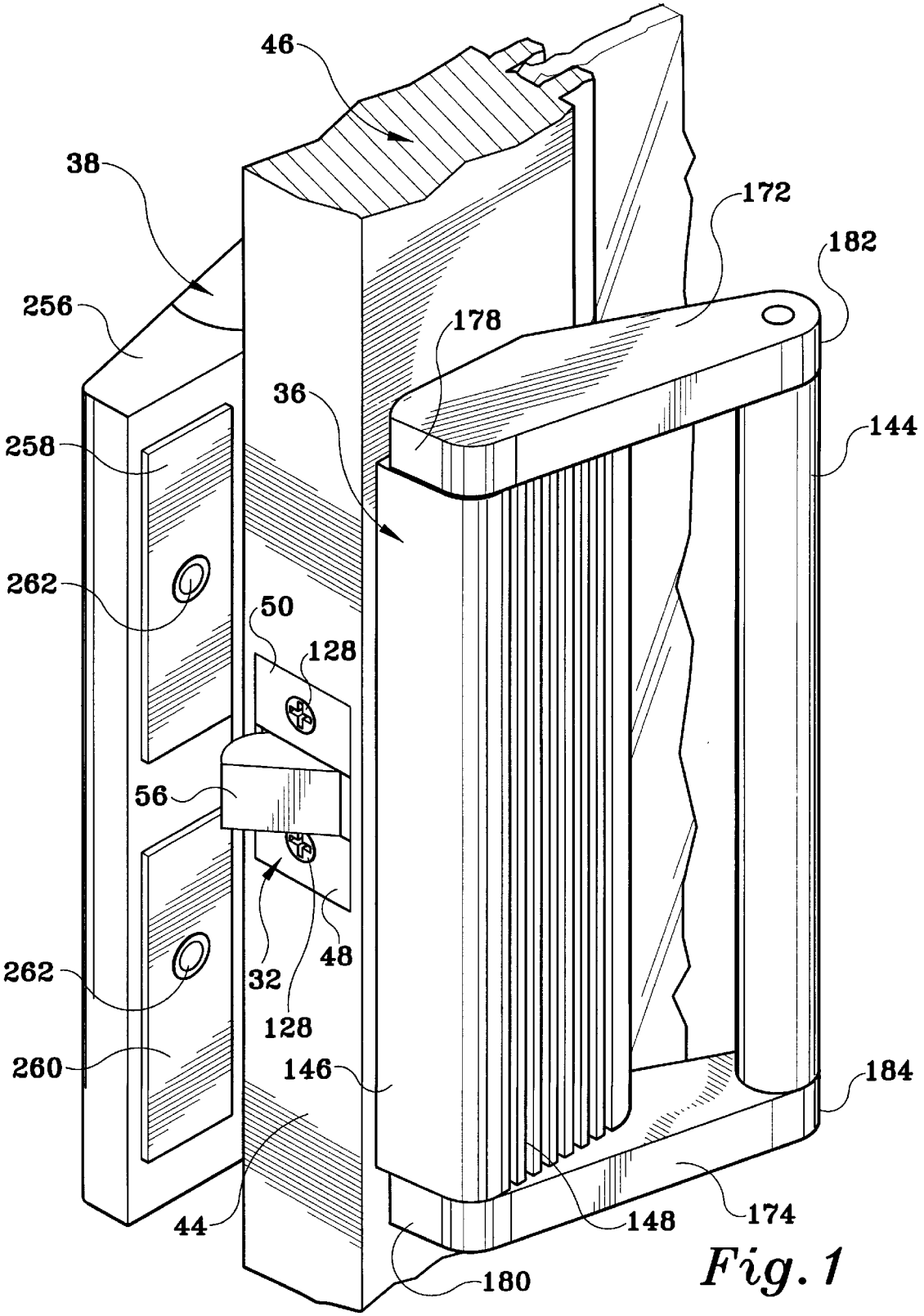
FIG. 1 is an environmental perspective view showing the door mounted portions of the electromagnetic lock of the present invention.
Figure 2:
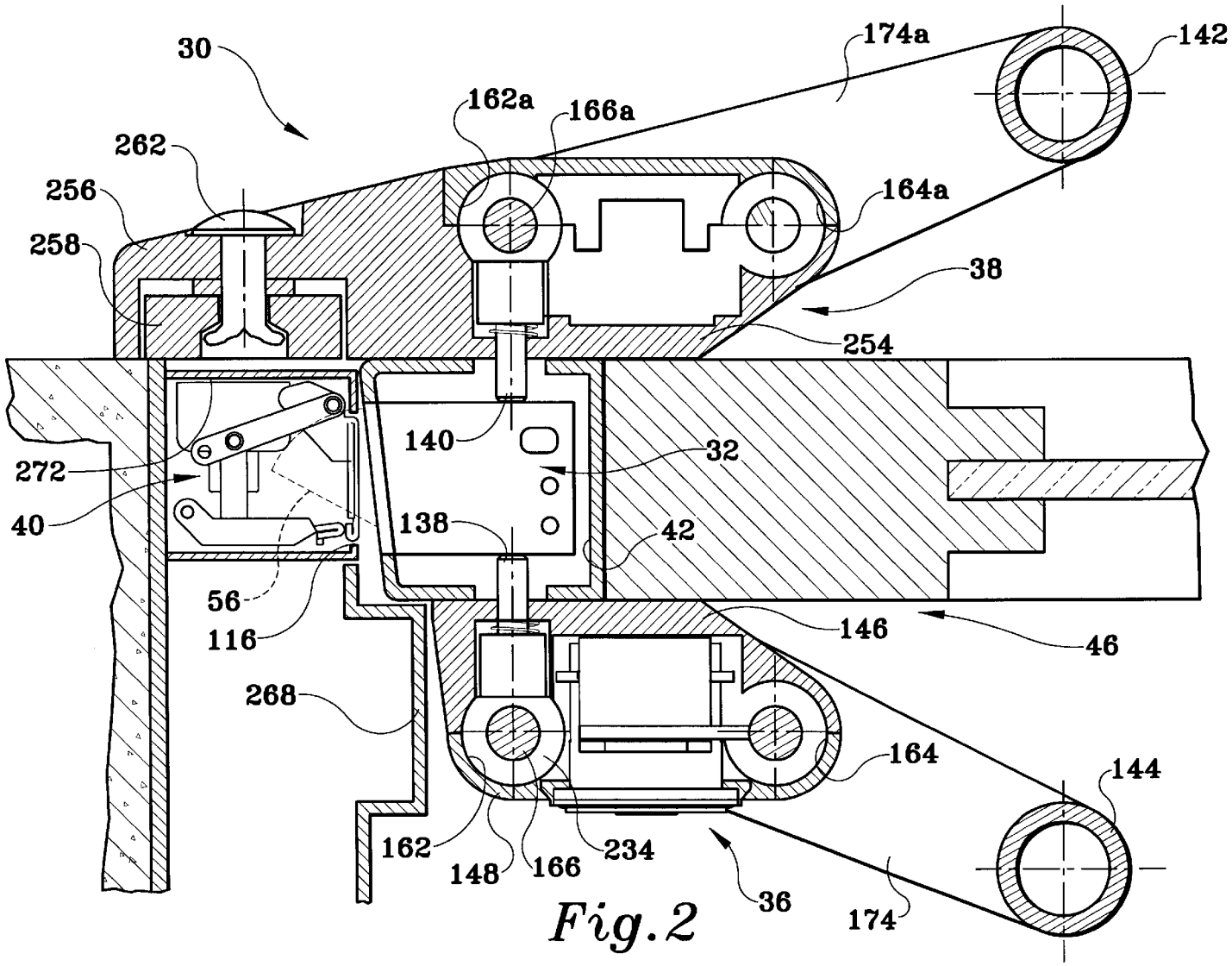
FIG. 2 is a top cross sectional view of the electromagnetic lock of the present invention.
Figure 7:
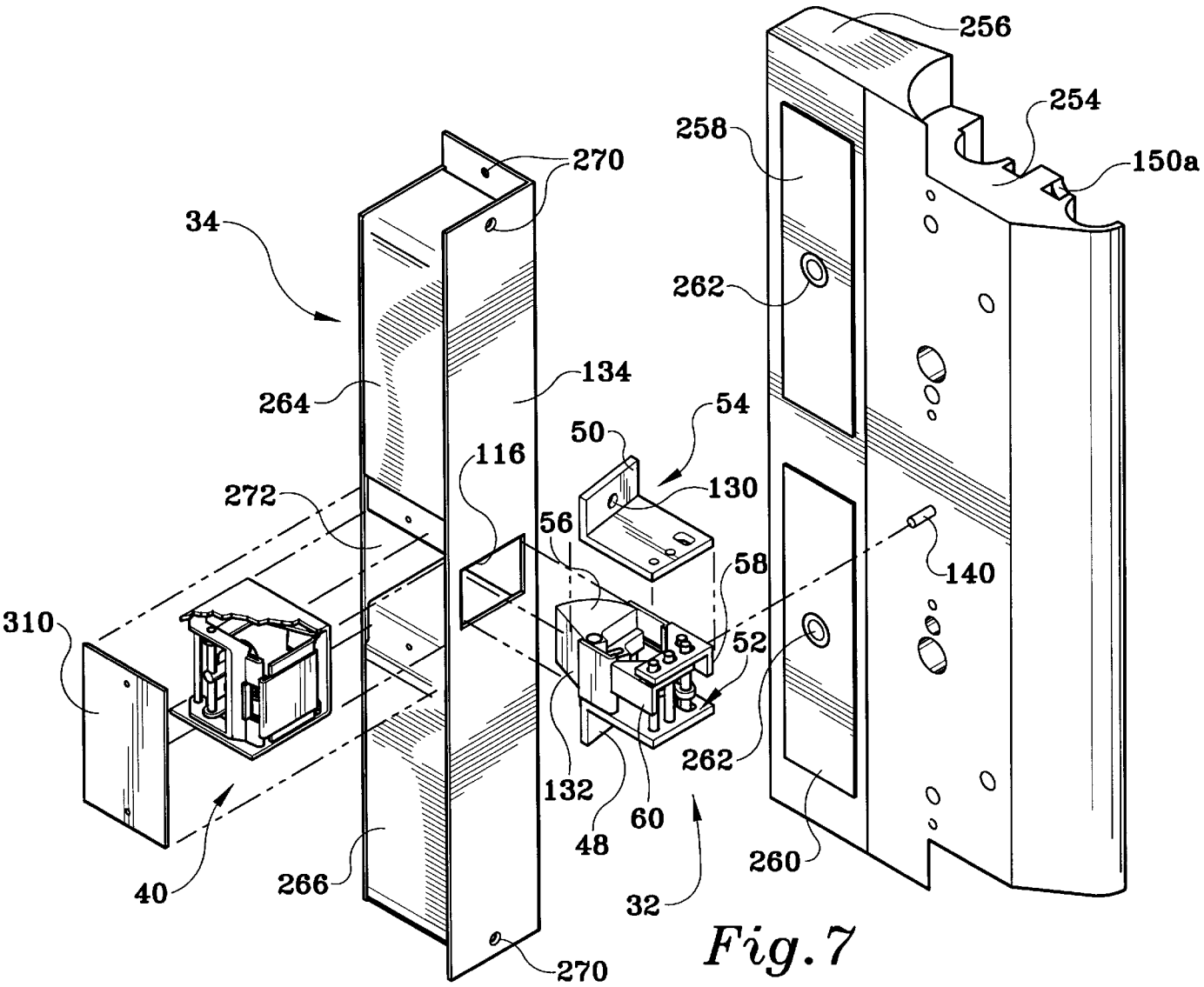
FIG. 7 is an exploded view illustrating the spacial relationship between the pull-handle base, the latch mechanism, the latch pusher mechanism, and the electromagnet housing.
Figure 8:
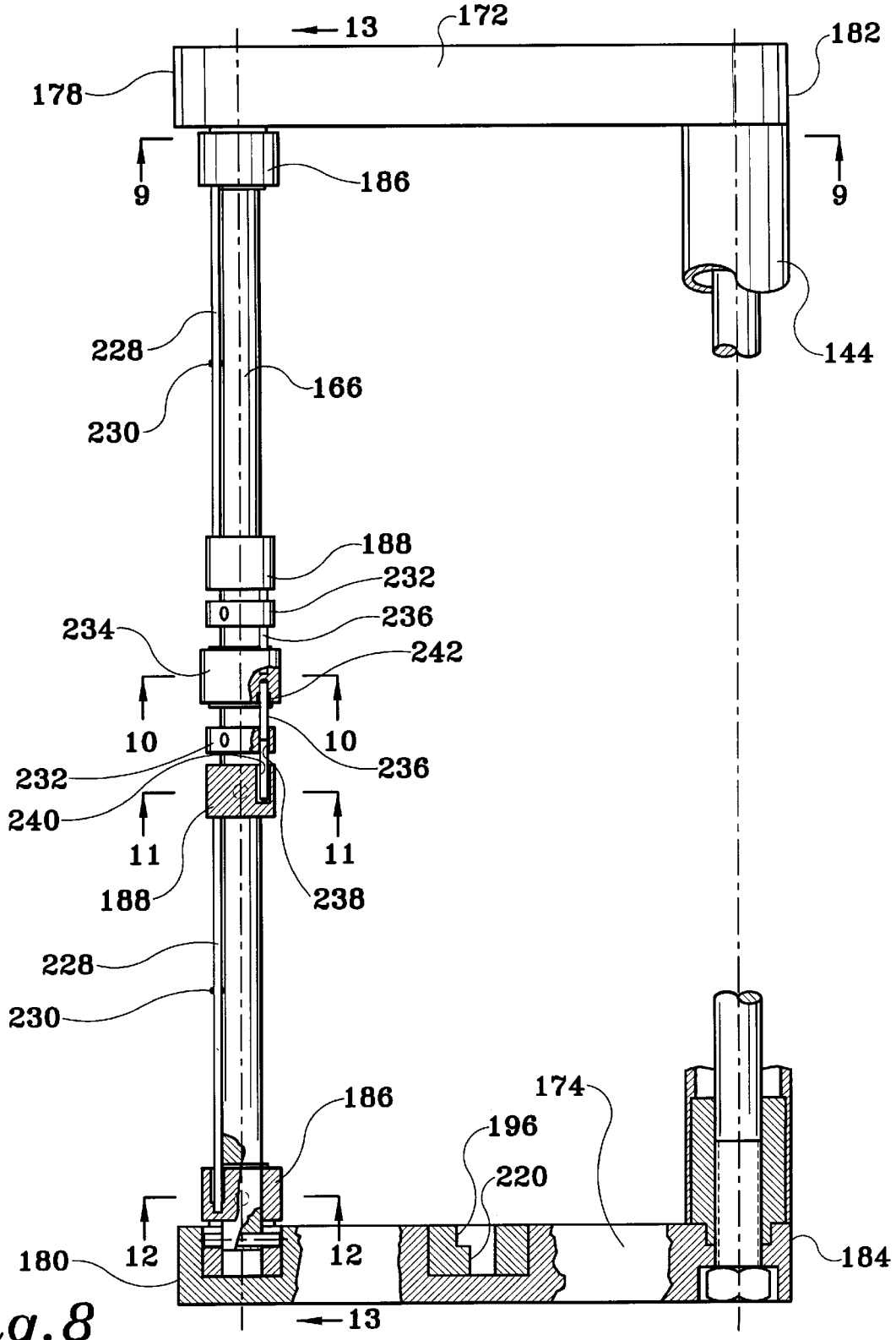
FIG. 8 is an elevational view of the push handle partially broken away to reveal internal details.

Referring to FIGS. 1, 2, and 7, the present invention is an electromagnetic lock 30. The lock 30 includes a latch assembly 32, an electromagnet assembly 34, a push-handle assembly 36, a pull-handle assembly 38, and a latch pusher mechanism 40. A cavity 42 opening to the vertical surface 44 of the door 46, houses the latch assembly 32. The latch assembly 32 is retained in cavity 42 by the vertical flanges 48 and 50 of the latch support brackets 52 and 54. The brackets 52 and 54 position the latch 56 so as to allow the latch 56 to protrude from the opening of the cavity 42.

Figure 14A:
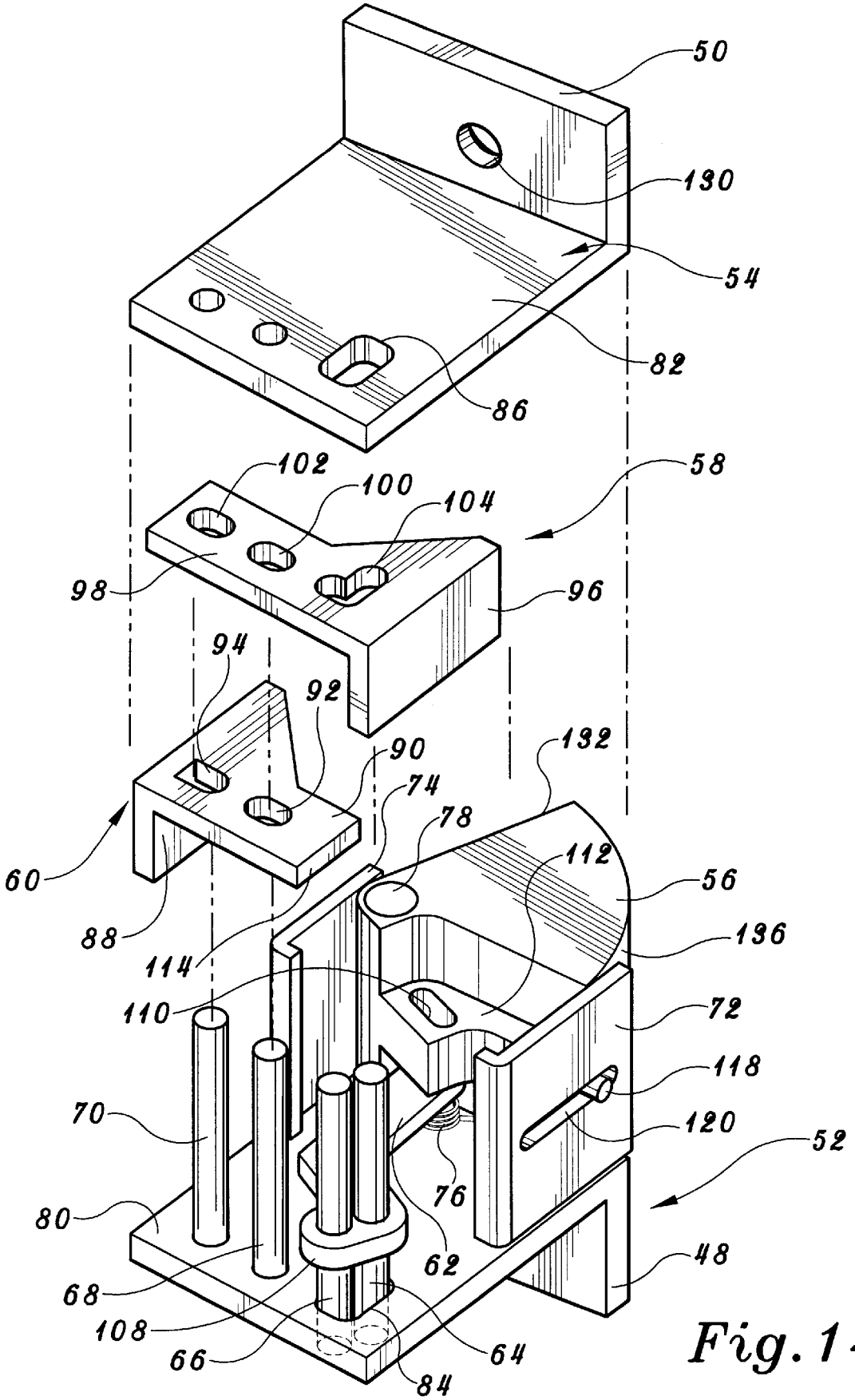
FIG. 14A is an exploded view of the latch assembly of the electromechanical lock of the present invention.
Figure 14B:
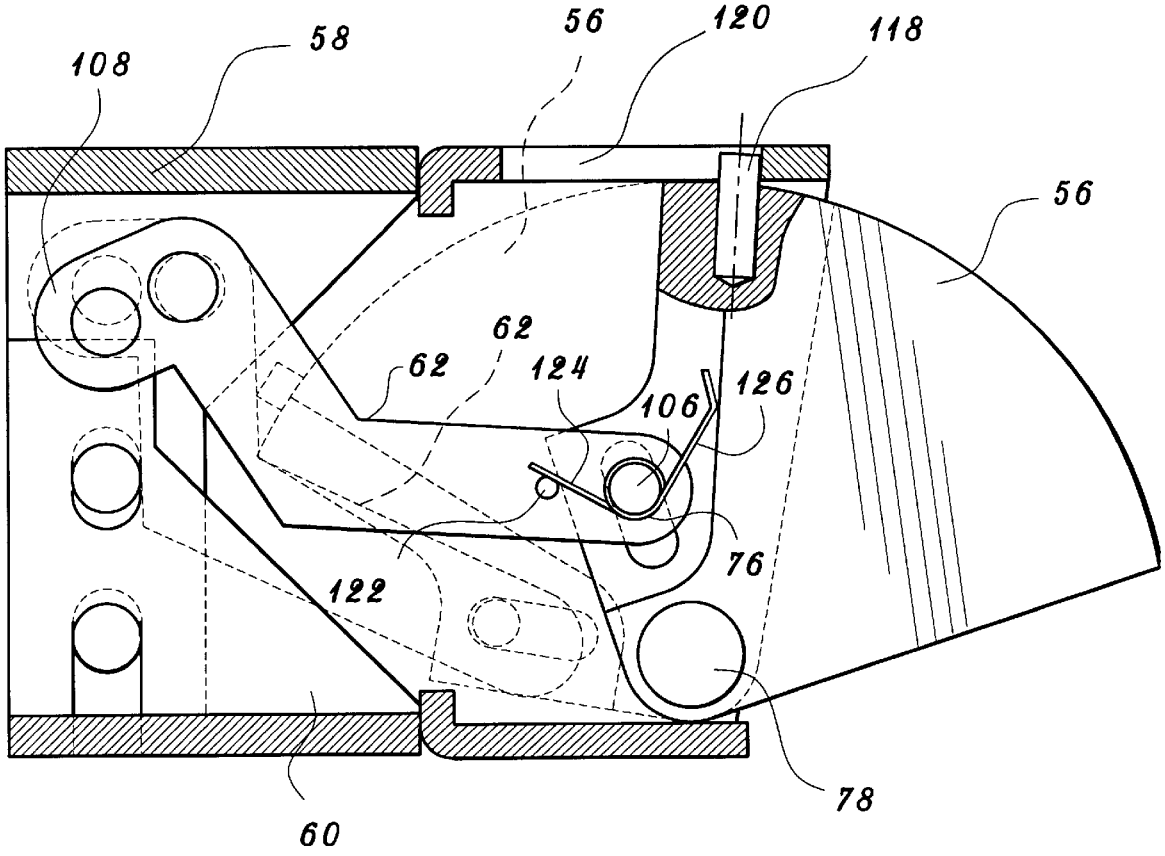
FIG. 14B is a bottom cross sectional view of the latch assembly of the electromechanical lock of the present invention, showing the latch retractor arm at the extremes of its movement.
Figure 15:
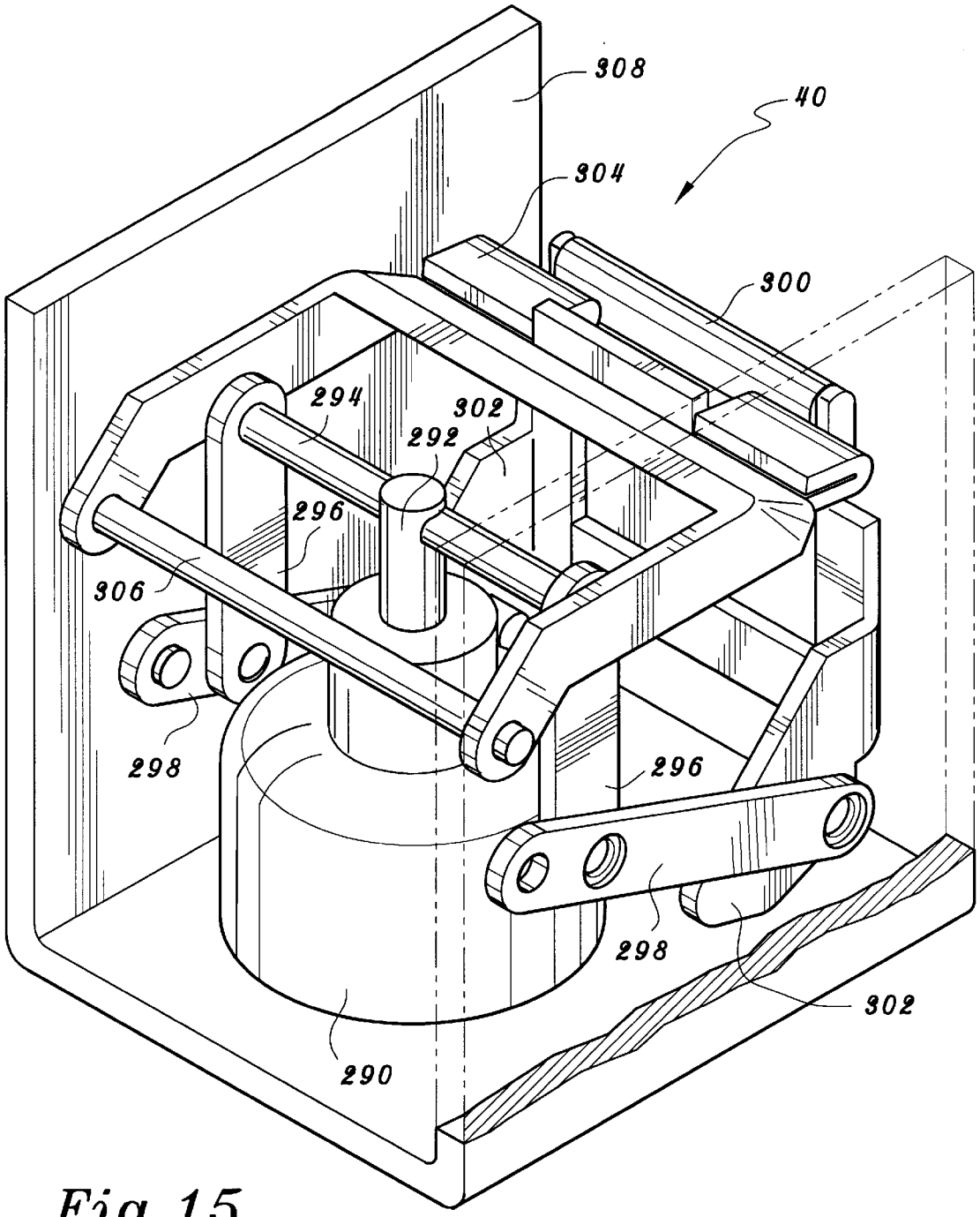
FIG. 15 is a perspective view of the latch pusher mechanism of the electromechical lock of the present invention.

Referring to FIGS. 7, 14A, and 14B, the latch assembly 32 includes latch support brackets 52 and 54, the latch 56, push pads 58 and 60, latch retractor arm 62, first and second latch retractor arm pivot pins 64 and 66, first and second push pad guide pins 68 and 70, side plates 72 and 74, and torsion spring 76. The shaft 78 rotatably supports latch 56 within the latch assembly 32. Ends of shaft 78 are supported by the horizontal portions 80 and 82 of the support brackets 52 and 54. Roughly rectangular openings 84 and 86 in the support brackets 52 and 54 movably support the ends of the first and second latch retractor arm pivot pins 64 and 66. The openings 84 and 86 allow movement of the pivot pins 64 and 66, however this movement is confined to the area circumscribed by the perimeter of the openings 84 and 86.

The push pad 60 has a vertical portion 88 and a horizontal portion 90. The horizontal portion 90 has two elongated slots 92 and 94. When the latch assembly 32 is fully assembled, guide pins 68 and 70 will pass through slots 92 and 94 respectively. In cooperation with the elongated slots 92 and 94, the guide pins 68 and 70 will confine the push pad 60 to movement in a direction normal to the plane of the vertical portion 88 of the push pad 60. Similarly, the push pad 58 has a vertical portion 96 and a horizontal portion 98. The horizontal portion 98 has two elongated slots 100 and 102. In addition, the horizontal portion 98 has a roughly L-shaped slot 104. When the latch assembly 32 is fully assembled, guide pins 68 and 70 will pass through slots 100 and 102 respectively. In cooperation with the elongated slots 100 and 102, the guide pins 68 and 70 will confine the push pad 58 to movement in a direction normal to the plane of the vertical portion 96 of the push pad 58. Also when the latch assembly 32 is fully assembled, the pivot pins 64 and 66 pass through the L-shaped slot 104. The pivot pin 64 passes through the portion of the L-shaped slot 104 which extends substantially parallel to the vertical portion 96 of the push pad 58. The pivot pin 66 passes through the portion of the L-shaped slot 104 which extends substantially perpendicularly to the vertical portion 96 of the push pad 58.

The latch retractor arm 62 has a first end and a second end. A pin 106 passes through the first end of the latch retractor arm 62. The latch retractor arm 62 has a bend intermediate its first and second ends. The latch retractor arm 62 also has an extension 108 projecting from the second end thereof. The pivot pin 64 passes through the second end of the latch retractor arm 62, while the pivot pin 66 passes through the extension 108. The pin 106 passes through a slot 110 formed in a rib 112 on the back of the latch 56.

The push pad 58 is movable between a first position and a second position. Similarly, the push pad 60 is movable between a first position and a second position. With push pad 58 in the first position, the vertical portion 96 is substantially coplanar with side plate 72. In addition, the guide pin 68 is positioned at the end of the slot 100 which is distal from the vertical portion 96 while the guide pin 70 is positioned at the end of the slot 102 which is distal from the vertical portion 96. With push pad 60 in the first position, the vertical portion 88 is substantially coplanar with side plate 74. In addition, the guide pin 68 is positioned at the end of the slot 92 which is distal from the vertical portion 88 while the guide pin 70 is positioned at the end of the slot 94 which is distal from the vertical portion 88. The push pads 58 and 60 are prevented from sliding down the guide pins 68 and 70, for example by rails (not shown) projecting from the sides of the cavity 42. These rails would pass under the vertical portions 88 and 96 and prevent vertical movement of the push pads 60 and 58, while allowing horizontal movement of the push pads 60 and 58. Therefore, with the push pads 58 and 60 in their respective first positions, the push pads 58 and 60 are only capable of moving inward relative to the latch assembly 32. In other words, with the push pads 58 and 60 in their respective first positions, the push pad 58 can only move toward the vertical portion 88 of the push pad 60 while the push pad 60 can only move toward the vertical portion 96 of the push pad 58.

With both push pads 58 and 60 in their respective first positions, consider the situation where the latch retractor arm 62 is in the extended position illustrated in solid line in FIG. 14B. Under these circumstances, the pivot pin 64 passes through the portion of the L-shaped slot 104 extending substantially parallel to the vertical portion 96 of the push pad 58. Also, the pivot pin 66 is located as distally as possible from the vertical portion 96, along the portion of the L-shaped slot 104 extending substantially perpendicularly to the vertical portion 96 of the push pad 58. In addition, the edge 114 of the push pad 60, located distally from the vertical portion 88, is in abutting contact with the pivot pin 66.

If the vertical portion 88 of the push pad 60 is pushed in toward the guide pin 70, the pivot pin 64 cannot move closer to the vertical portion 96 of the push pad 58 because it abuts the edge, proximate the vertical portion 96, of the portion of the L-shaped opening 104 extending parallel to the vertical portion 96. However, the pivot pin 66 will be pushed closer to the vertical portion 96, as the push pad 60 is being pushed in, by the edge 114 of the push pad 60. The movement of the pivot pin 66 relative to the pivot pin 64 and toward the vertical portion 96 of the push pad 58, has the effect of pivoting the latch retractor arm 62 from the extended position, illustrated in solid line in FIG. 14B, to the first retracted position illustrated in dashed line in FIG. 14B.

If the vertical portion 96 of the push pad 58 is pushed in toward the guide pin 68, the pivot pin 66 remains stationary relative to the support bracket 52 because its movement is resisted by the edge, proximate the guide pin 68, of the opening 84 and the edge 114 of the push pad 60. However, the pivot pin 64 will be pushed in, as the push pad 58 is being pushed in, by the portion of the substantially L-shaped slot 104 extending parallel to the vertical portion 96. The movement of the pivot pin 64 relative to the pivot pin 66 toward the push pad 60 has the effect of pivoting the latch retractor arm 62 from the extended position, illustrated in solid line in FIG. 14B, to a second retracted position (not shown) roughly the same as the first retracted position illustrated in dashed line in FIG. 14B.

Regardless of which of the push pads 58 and 60 are being pushed in, the pivot pin 66 moves closer to the vertical portion 96 as the latch retractor arm 62 pivots from the extended position to the retracted position. The distance between the pivot pin 66 and the pivot pin 64 is fixed by virtue of the fact that the holes in the latch retractor arm 62 through which the pivot pins 66 and 64 pass are a fixed distance apart. Therefore, as the pivot pin 66 moves closer to the vertical portion 96, the pivot pin 64 will be displaced slightly in a direction parallel to the vertical portion 96 toward the latch 56. The dimensions of the portion, parallel to the vertical portion 96, of the L-shaped slot 104 and the openings 84 and 86 are chosen so as to accommodate the displacement of the pivot pin 64 in the direction parallel to the vertical portion 96.

As the latch retractor arm 62 moves from the extended position to the first retracted position, the pin 106 exerts a torque on the latch 56 thus causing the latch 56 to pivot about the shaft 78 from the protruding position shown in solid line to the first retracted latch position shown in dashed line (see FIG. 14B). Similarly, as the latch retractor arm 62 moves from the extended position to the second retracted position, the pin 106 exerts a torque on the latch 56 causing the latch 56 to pivot about the shaft 78 from the protruding position shown in solid line to a second retracted latch position roughly the same as the first retracted latch position. In either the first or the second retracted latch position, the latch 56 is completely withdrawn from the opening 116 in the electromagnet assembly 34 (see FIG. 7). The reason the first retracted latch position is slightly different from the second retracted latch position is that, depending upon which of the push pads 58 and 60 is being pushed in, the final retracted position of the latch retractor arm 62 and thus the resulting retracted latch position will vary slightly. However, the geometries of the latch 56, the latch retractor arm 62, and the push pads 58 and 60 are designed such that in either the first or the second retracted latch position the latch 56 will not interfere with the opening of the door 46.

The pin 106 projects outward from either side of the latch retractor arm 62. The portion of the pin 106, projecting from the top side of the latch retractor arm 62, engages the slot 110 and imparts movement to the latch 56 as a result of the movement of the latch retractor arm 62. The portion of the pin 106, projecting from the bottom side of the latch retractor arm 62, passes through the coiled portion of the torsion spring 76 and rotatably supports the torsion spring 76. Also projecting from the bottom side of the latch retractor arm 62, is a projection 122 which is fixed to the latch retractor arm 62. The torsion spring 76 has two arms 124 and 126. The arm 124 is in contact with the projection 122, while the arm 126 is in contact with the back side of the latch 56. As the latch retractor arm 62 and the latch 56 move toward their respective retracted positions, the ends of the arms 124 and 126 distal from the coiled portion of the torsion spring 76 are squeezed together between the projection 122 and the back side of the latch 56. Because the ends of the arms 124 and 126 distal from the coiled portion of the torsion spring 76 naturally tend to move apart from one another, the torsion spring 76 biases the latch 56 and the latch retractor arm 62 such that they tend to move to the protruding position and the extended position respectively. Therefore, in the absence of either the push pad 58 or the push pad 60 being pushed in, the latch 56 will tend to project outward from the latch assembly 32 under the impetus of the torsion spring 76.

The side plate 72 has a slot 120 formed therein. A set screw 118, fixed to the latch 56, slidably rides in the slot 120 as the latch 56 approaches the limit of its outward projection from the latch assembly 32. The set screw 118 limits the outward movement of the latch 56 and prevents the latch 56 from flying uncontrollably out of the latch assembly 32 under the impetus of the torsion spring 76.

As was previously stated, the latch assembly 32 is installed in the door 46 such that the latch 56 can project from the vertical surface 44 and register with the opening 116 when the door 46 is closed (see FIGS. 1, 2, and 7). The latch assembly 32 is mounted to the door 46 by screws 128 which pass through holes 130 (only one shown) formed in the vertical flanges 48 and 50 of the latch support brackets 52 and 54. With the door 46 initially open, the flat surface 132 will be the first part of the latch 56 to encounter the electromagnet housing 134 as the door 46 is closed. The impact of the electromagnet housing 134 on the surface 132 causes the latch 56 to be rotated to the retracted position, thus allowing the door 46 to close completely. Once the door 46 is completely closed, the latch 56 will be in registry with the opening 116 and the latch 56 will automatically move to the protruding position under the impetus of torsion spring 76. The latch 56 now engages the opening 116. If an attempt is now made to open the door 46, an edge of the opening 116 will impinge upon the arcuate surface 136 of the latch 56. The interaction of the arcuate surface 136 with the edge of the opening 116 tends to rotate the latch 56 out of the latch assembly 32, however this outward movement of the latch 56 is resisted by the set screw 118. Therefore the door 46 cannot be opened unless the latch 56 is moved to the retracted position, either by pushing in one of the push pads 58 and 60 or by pushing the latch 56 out of engagement with the opening 116 using the latch pusher mechanism 40.

With the latch assembly 32 mounted inside the cavity 42, the pull-handle assembly 38 and the push-handle assembly 36 are bolted to the door 46 on either side of the cavity 42 as shown in FIG. 2. The push pins 138 and 140 pass through openings in either side of the cavity 42 and contact the vertical portions 88 and 96 of the push pads 60 and 58 respectively.

Figure 3:
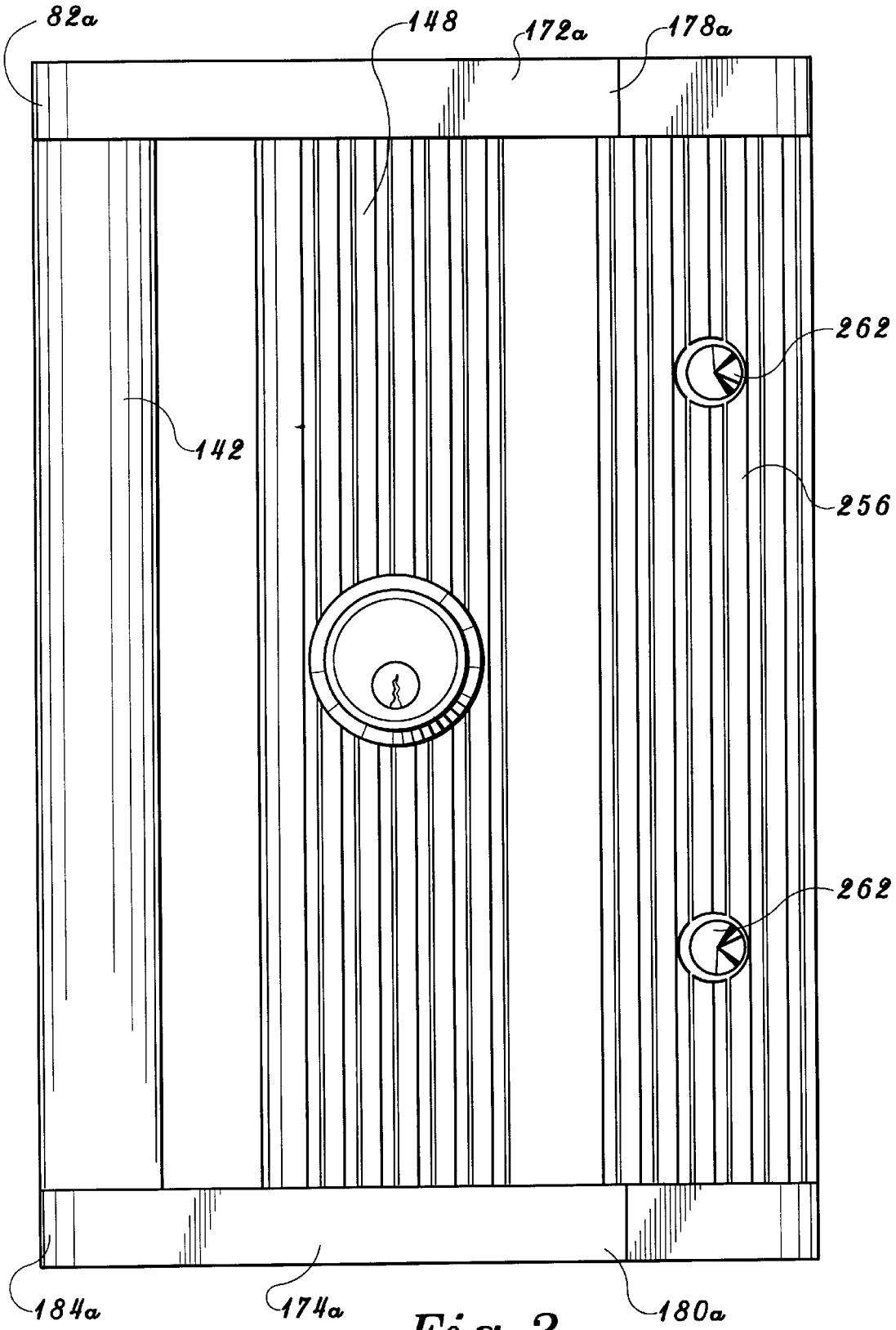
FIG. 3 is an elevational view of the electromagnetic lock of the present invention from the pull-handle side showing the position of the lock cylinder.

Pulling the pull handle 142 (see FIGS. 2 and 3) will cause push pin 140 to thrust outward and push in the push pad 58, while pushing the push handle 144 (see FIGS. 1 and 2) will cause push pin 138 to thrust outward and push in the push pad 60. Thus, pulling the pull handle 142 or pushing the push handle 144 will effect the withdrawal of the latch 56 from the opening 116 (see FIG. 7), which is necessary for opening the door 46.

Referring to FIGS. 1, 2, 4B, 5, 6, 8, and 9–13, the operation and structure of the push-handle assembly will be explained. The push-handle assembly 36 is mounted on the interior of the door 46, proximate the vertical surface 44. The push-handle assembly 36 includes a base 146 and a cover 148. The base 146 and cover 148 are locked together by the T-shaped cross section dovetail 150 projecting from the inner surface of the base 146. The T-shaped cross section dovetail 150 fits into a groove 152 formed in the cover 148. The groove 152 and dovetail 150 are interrupted so that the cover 148 can be placed in contact with the base 146, and then the cover 148 can be slid into place bringing groove 152 into mating engagement with dovetail 150. The base 146 has a pair of substantially semi-cylindrical grooves 154 and 156. Similarly, the cover 148 has a pair of substantially semi-cylindrical grooves 158 and 160. With the cover 148 mated to the base 146, the grooves 154 and 158 cooperatively form a substantially cylindrical channel 162, and the grooves 156 and 160 cooperatively form a substantially cylindrical channel 164. Cylindrical channel 162 houses the main pivot shaft 166 for the push handle 144. Cylindrical channel 164 houses the locking rods 168 and 170.

The push handle 144 is substantially cylindrical and is adapted for grasping by a person opening or closing the door 46. The push handle 144 extends vertically between a top pivot arm 172 and a bottom pivot arm 174. The top and bottom pivot arms 172 and 174 are fixed to respective ends of the shaft 166. The shaft 166 is attached to the top and bottom pivot arms 172 and 174 at the broad ends 178 and 180 of the top and bottom pivot arms 172 and 174. The push handle 144 extends between the narrow ends 182 and 184 of the top and bottom pivot arms 172 and 174. The shaft 166 is rotatably supported by the collars 186 and 188 which are fixedly housed in the channel 162. Pins 190 engaging holes in the base 146 prevent the collars 186 and 188 from moving relative to the base 146 (see FIGS. 8, 11, 12 and 13). It should be readily apparent from the above description that the assembly, including the push handle 144, the top pivot arm 172, the bottom pivot arm 174, and the shaft 166, will pivot as a rigid body about the longitudinal axis of the shaft 166 as the push handle 144 is moved toward or away from the door 46.

Figure 6:
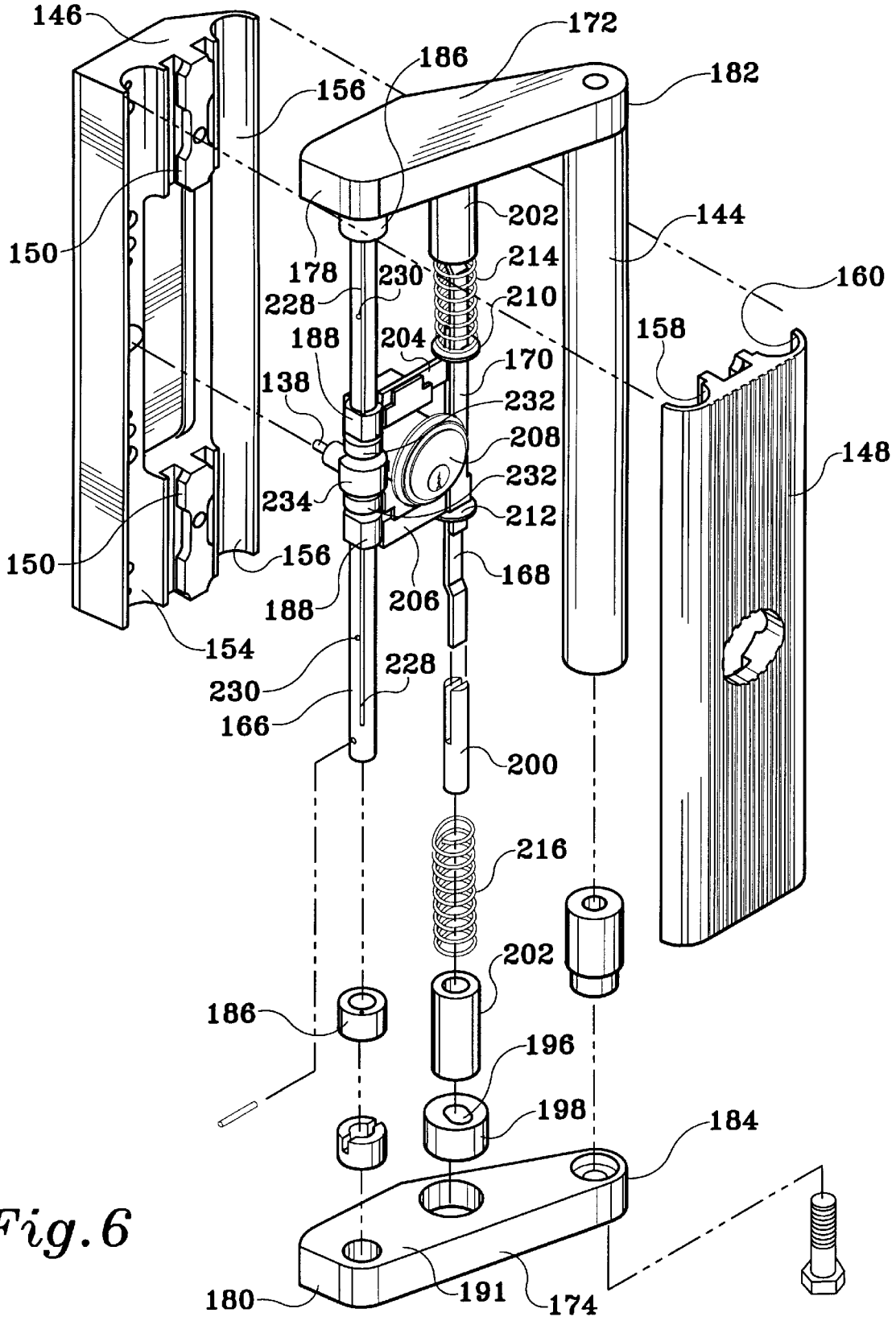
FIG. 6 is an exploded view of the push-handle assembly.
Figure 9:
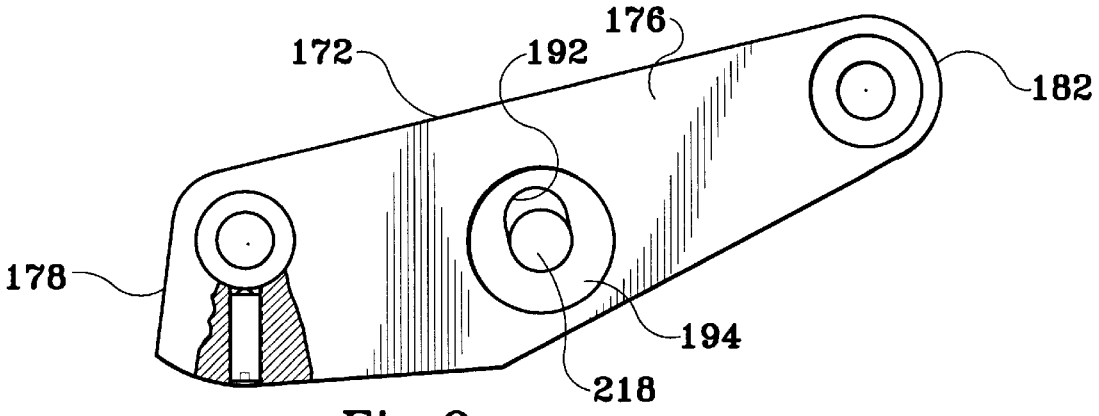
FIG. 9 shows the underside of the top pivoting member of the push handle.

Referring to FIGS. 6 and 9, the bottom surface 176 of the top pivot arm 172 and the top surface 191 of the bottom pivot arm 174 can be seen. The bottom pivot arm 174 is a mirror image of the top pivot arm 172. An arc shaped recess 192 is formed in an insert 194 which is embedded in the bottom surface 176 of the top pivot arm 172. A similar arc shaped recesses 196 is formed in an insert 198 which is embedded in the top surface 191 of the bottom pivot arm 174. Each of the locking rods 168 and 170 has a cylindrical attachment 200. Hollow cylindrical guides 202 keep the cylindrical attachments 200 centered within the cylindrical channel 164 while allowing the locking rods 168 and 170 to reciprocatingly move within the cylindrical channel 164. The locking rods 168 and 170 have horizontal projections 204 and 206 respectively. The horizontal projection 204 is positioned above the cylinder lock 208 of the push handle while the horizontal projection 206 is positioned below the cylinder lock 208, such that a portion of the locking rod 170 overlaps a portion of the locking rod 168. A washer 210 abuts the horizontal projection 204. The locking rod 170 passes through the washer 210 and can reciprocate freely relative to the washer 210. Similarly, a washer 212 abuts the horizontal projection 206, and the locking rod 168 passes through the washer 212 and can reciprocate freely relative to the washer 212. A coil spring 214 is located intermediate the washer 210 and a respective one of the cylindrical guides 202. Similarly, a coil spring 216 is located intermediate the washer 212 and a respective one of the cylindrical guides 202.

The cylindrical attachment 200 of the locking rod 170 fits into the arc shaped recess 192, while the cylindrical attachment 200 of the locking rod 168 fits into the arc shaped recess 196. The spring 214 biases the cylindrical attachment 200 of the locking rod 168 to project as deeply as possible into the arc shaped recess 196. The spring 216 biases the cylindrical attachment 200 of the locking rod 170 to project as deeply as possible into the arc shaped recess 192. The push handle 144 can pivot between a locked position and an unlocked position. The push handle 144 is closer to door 46 in the unlocked position than it is in the locked position. The recesses 192 and 196 define the limits of movement of the push handle 144. At the end of the recess 192, closest to the door 46, is a deeper portion 218. Similarly, at the end of the recess 196, closest to the door 46, is a deeper portion 220 (see also FIG. 8). When the push handle 144 is in the locked position, the deeper portions 218 and 220 register with the cylindrical attachments 200. The cylindrical attachments 200 move into the deeper portions 218 and 220 under the impetus of the springs 216 and 214. With the cylindrical attachments 200 inserted into the deeper portions 218 and 220 of the recesses 192 and 196, the push handle 144 is locked in place and is prevented from pivoting.

Figure 23:
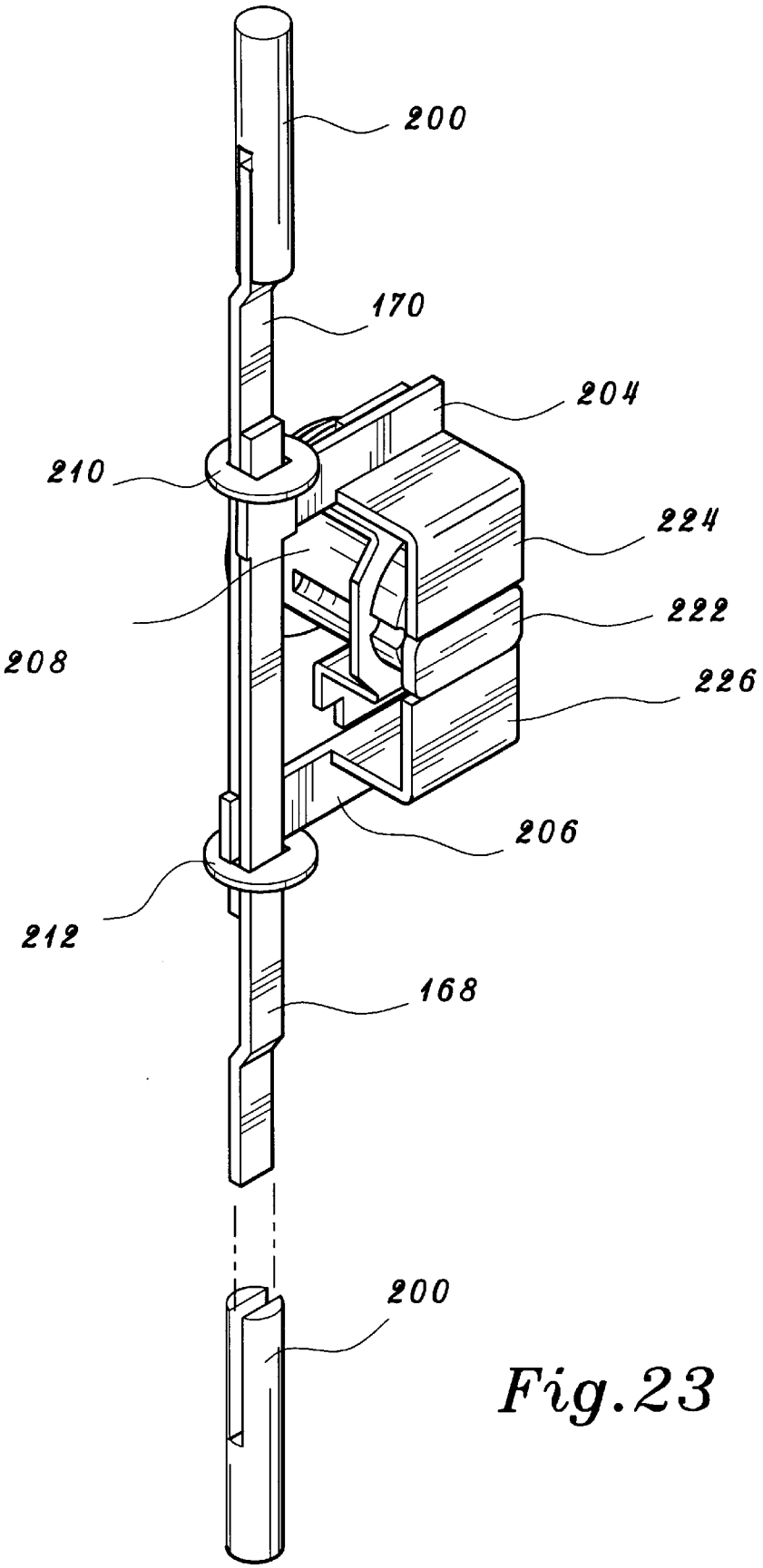
FIG. 23 is a rear perspective view showing the cylinder lock and the locking rods of the push-handle assembly in isolation.
Figure 24:
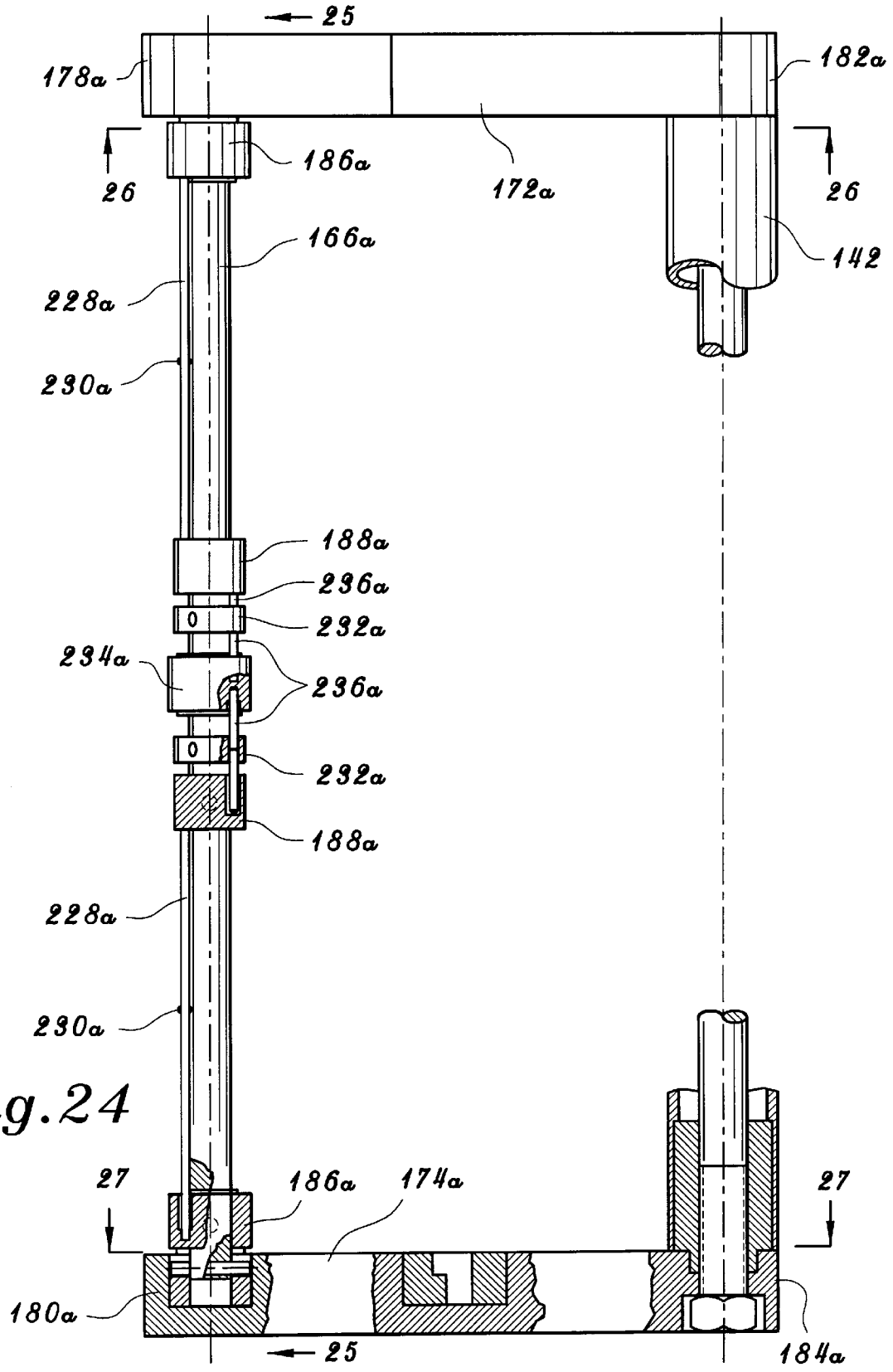
FIG. 24 is an elevational view of the pull handle partially broken way to reveal internal details.

To operate the push handle 144 and effect the opening of the door 46, the appropriate key (not shown) must be inserted into the cylinder lock 208. Turning the key, and thus the cylinder lock 208, turns the cam bar 222 (see FIG. 23) which is rigidly fixed to the cylinder lock 208. As the cam bar 222 turns, brackets 224 and 226 are pushed apart. The bracket 224 is fixed to the horizontal projection 204 of the locking rod 168, while the bracket 226 is fixed to the horizontal projection 206 of the locking rod 170. It should be readily apparent that as the brackets 224 and 226 are pushed apart, the locking rod 168 is pulled up while the locking rod 170 is pulled down. The cylindrical attachments 200 being fixed to the locking rods 168 and 170, the cylindrical attachments 200 will be withdrawn from the deeper portions 218 and 220 of the recesses 192 and 196 as the cylinder lock 208 is turned. Withdrawal of cylindrical attachments 200 from the deeper portions 218 and 220 allows the push handle 144 to pivot to the unlocked position as the handle 144 is pushed by a user.

As the push handle 144 pivots to the unlocked position, the shaft 166 is rotated. As was stated previously, the collars 186 and 188 remain stationary as the shaft 166 pivots. Each set of collars 186 and 188 has a spring rod 228 extending therebetween, parallel to the shaft 166 (see FIGS. 6, 8, and 13). Viewing the shaft 166 from above, the shaft 166 rotates in a counter clockwise direction as the handle 144 moves to the unlocked position. A pair of pins 230 project perpendicularly from the shaft 166. The pins 230 are located clockwise from the spring rods 228 and abut the spring rods 228 when the handle 144 is in the locked position. Therefore, the handle 144 can only be moved to the unlocked position if the spring rods 228 bend due to the action of the pins 230. The spring rods 228 are sufficiently resilient such that they will bend without exceeding their elastic limit over the range of movement of the pins 230. Further, the spring rods 228 will tend to return to their straight configuration once the handle 144 is released. Thus the spring rods 228 bias the handle 144 toward the locked position.

Located intermediate the two collars 188, there are two collars 232. The collars 232 are fixed to the shaft 166 and rotate therewith. Intermediate the collars 232, is a collar 234 (see FIGS. 2, 6, 8, 10, and 13). The collar 234 is free to rotate relative to the shaft 166. The collars 232 have passages 238 extending therethrough. Each of the collars 188 has a socket 240 which faces the collar 234 (see also FIG. 11). The collar 234 has a pair of sockets 242. Each socket 242 faces a respective one of the collars 232. With the handle 144 in the locked position, the sockets 242, the passages 238, and the sockets 240 are all in registry with one another. Each socket 242 houses an end of a respective actuating rod 236. Each actuating rod 236 passes through a respective passage 238 and has its end, distal from the collar 234, housed in a respective socket 240. The collars 188 and thus the sockets 240 are stationary. Therefore the ends of the actuating rods 236 housed in the sockets 240 will also be substantially stationary. The collars 232 are fixed to the shaft 166, therefore the portions of the actuating rods 236 located in passages 238 will be displaced as the shaft 166 rotates. The actuating rods 236 are substantially rigid, therefore as the portions of the actuating rods 236 located in passages 238 are displaced, substantially the entire length of the actuating rods 236 will be displaced through substantially the same angular displacement. The vertex of the angular displacement is located at or near each socket 240, therefore the actual displacement of a portion of either of the actuating rods 236 will be greater the farther that portion is from the respective socket 240. Therefore, the end of the rods 236 located in sockets 242 will be displaced a greater amount than the displacement of the portions of the actuating rods 236 located in passages 238. The amount of rotation of the collar 234 is directly related to the displacement of the ends of the rods 236 housed in sockets 242. In this way, the actuating rods 236 amplify the rotation of the shaft 166, causing the collar 234 to rotate a greater amount for a given rotation of the shaft 166.

Figure 10:
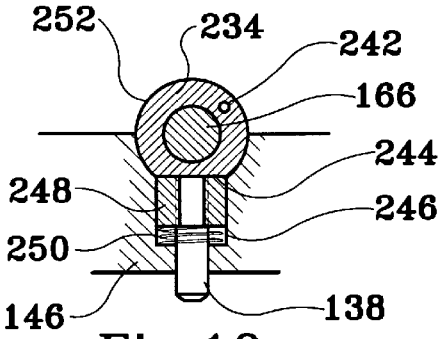
FIG. 10 is a fragmentary view showing the push pin used to open the latch in both the pull-handle assembly and the push-handle assembly.
Figure 11:
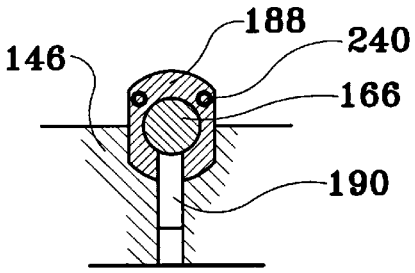
FIG. 11 is a fragmentary view showing the fixed collar which supports one end of the spring rod and the fixed end of the motion amplification rod.
Figure 12:
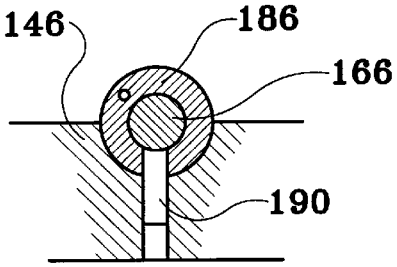
FIG. 12 is a fragmentary view showing the fixed collar which supports one end of the spring rod.
Figure 13:
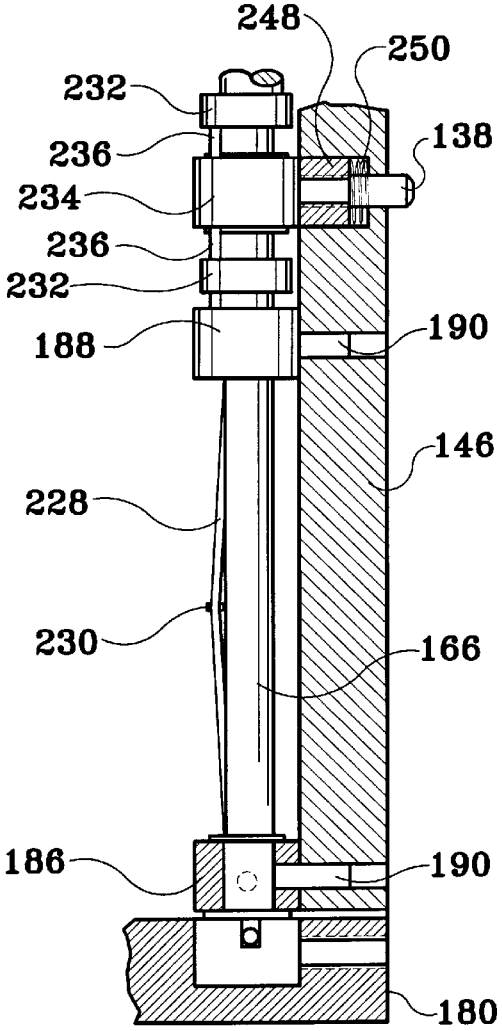
FIG. 13 is a fragmentary view showing the relationship of the pivot shaft of the push handle with the push-handle base.

Referring to FIG. 10, the collar 234 fits over a cavity 246. The collar 234 has a flat 244 which is aligned with the cavity 246 when the handle 144 is in the locked position. The push pin 138 threadedly engages a sleeve 248 housed in the cavity 246. A coil spring 250 biases the sleeve 248 into abutting contact with the collar 234. As the collar 234 rotates, the flat 244 comes out of alignment with the cavity 246 while the arcuate surface 252 moves into alignment with the cavity 246. With the arcuate surface 252 in alignment with the cavity 246, more of the collar 234 projects into the cavity 246 causing the sleeve 248 to be thrust deeper into the cavity 246 and thus causing the push pin 138 to be thrust farther outward from the base 146. Movement of the handle 144 from the locked position to the unlocked position, causes rotation of the shaft 166. Rotation of the shaft 166 in turn causes the rotation of the collar 234 through the motion amplification mechanism described earlier. Rotation of the collar 234 causes the push pin 138 to thrust farther into the cavity 42. Thus movement of the handle 144 to the unlocked position causes the push pin 138 to thrust farther into the cavity 42 and push in the push pad 60. As was explained earlier, pushing in the push pad 60 causes the latch 56 to be withdrawn from the opening 116, which is necessary for opening the door 46.

Figure 4A:
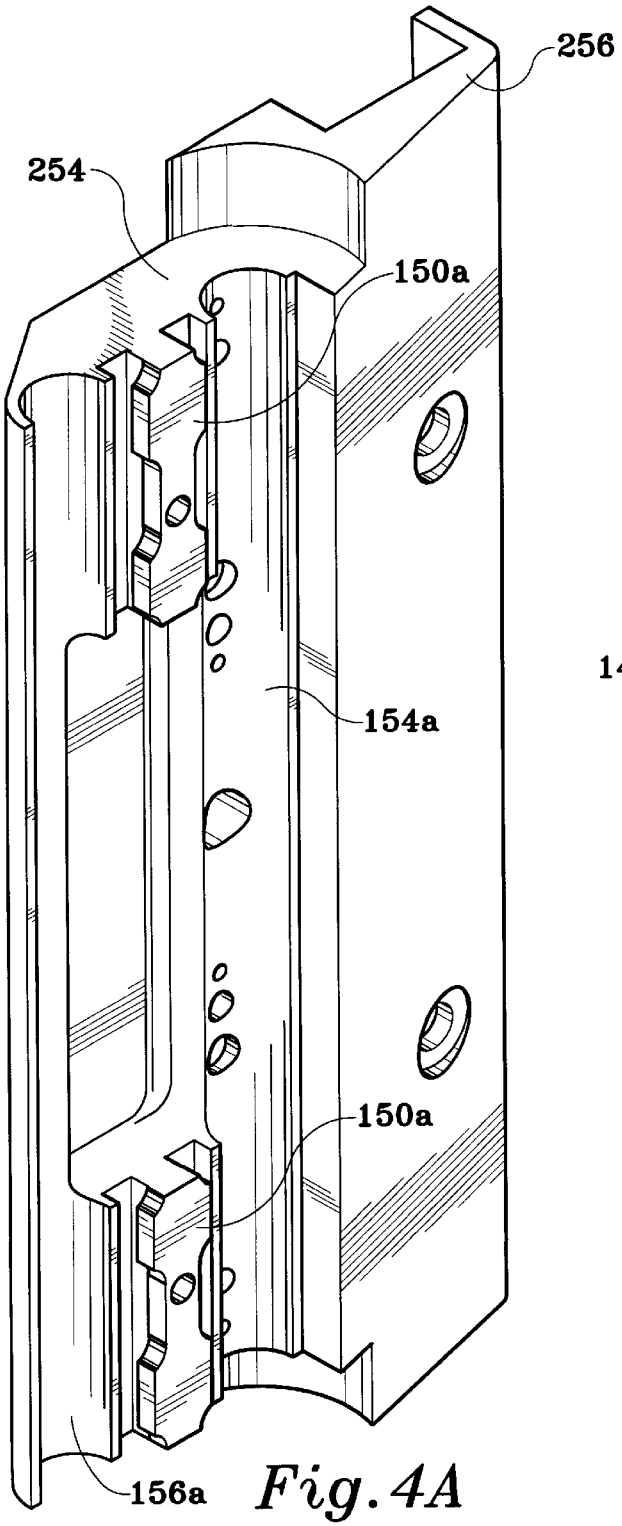
FIG. 4A is a perspective view of the base of the pull-handle assembly.
Figure 4B:
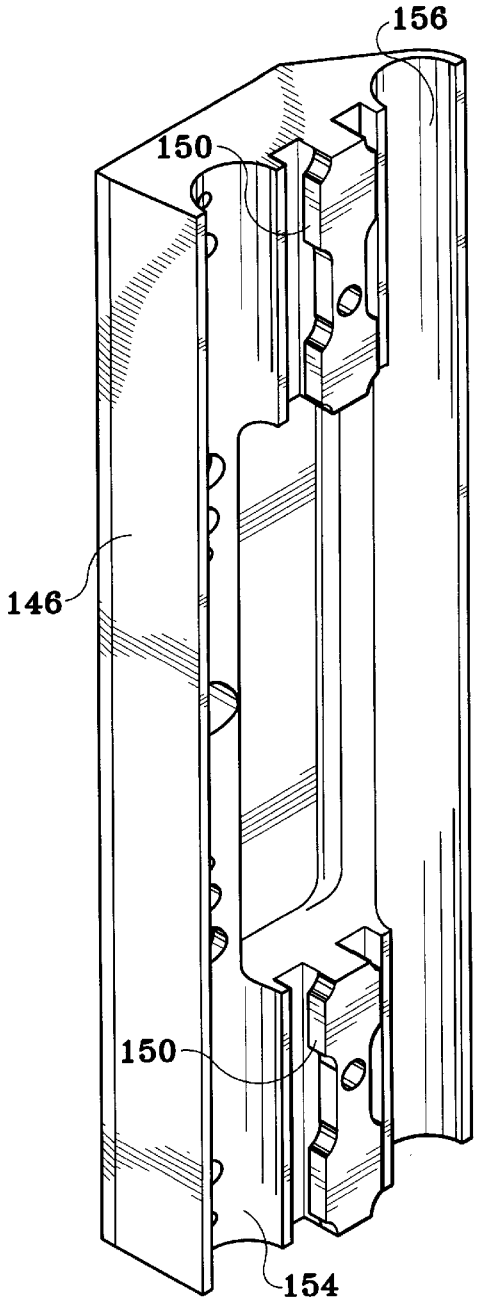
FIG. 4B is a perspective view of the base of the push-handle assembly.
Figure 5:
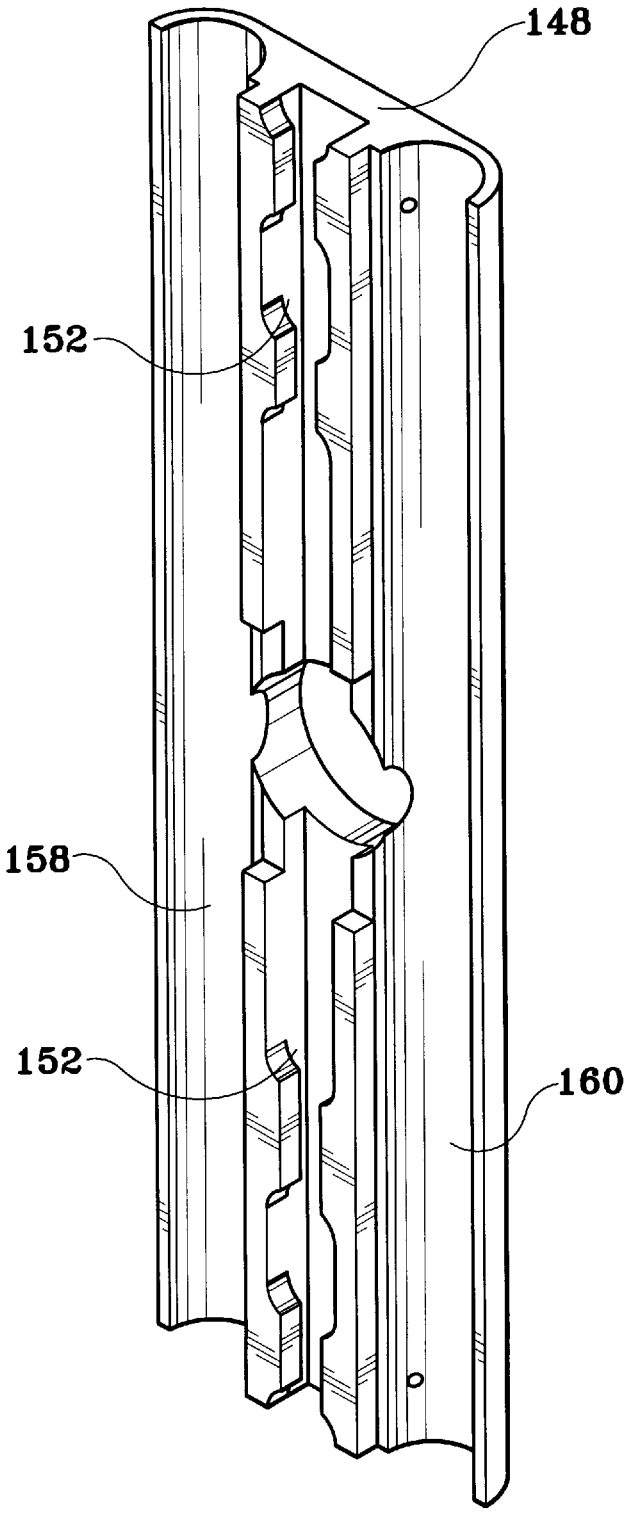
FIG. 5 is a perspective view of the cover usable with both the push-handle assembly and the pull-handle assembly.

The pull-handle assembly 38 is substantially similar to the push-handle assembly 36 described in detail above. The pull-handle assembly 38 is essentially a mirror image of the push-handle assembly 36, with some differences which will become apparent from the description below. Referring to FIGS. 1, 2, 3, 4A, 5, 6, 7, 10–12, and 24–28, the pull-handle assembly 38 includes a base 254, shown in detail in FIG. 4A, and a cover 148, shown in detail in FIG. 5. The base 254 is essentially a mirror image of the base 146, except that the pull-handle base 254 includes an extension 256 which extends across the gap between the surface 44 and the electromagnet housing 134 when the door 46 is closed. The extension 256 is dimensioned such that it fits over the electromagnet housing 134, when the door 46 is closed. The extension 256 houses two ferromagnetic cores 258 and 260. Ferromagnetic cores 258 and 260 are kept in place by rivets 262. Ferromagnetic as used herein means any material that can be attracted by a magnet. Preferably, the cores 258 and 260 are made of a ferrous material, however any solid ferromagnetic material may be used in the cores 258 and 260. Cores 258 and 260 register with the upper electromagnet compartment 264 and the lower electromagnet compartment 266 respectively when the door 46 is closed (see FIG. 7).

As with the push-handle assembly 36, the base 254 and cover 148 are locked together by a T-shaped cross section dovetail 150*a* projecting from the inner surface of the base 254. The T-shaped cross section dovetail 150*a* fits into a groove 152 formed in the cover 148. The groove 152 and dovetail 150*a* are interrupted so that the cover 148 can be placed in contact with the base 254, and then the cover 148 can be slid into place bringing groove 152 into mating engagement with dovetail 150*a* (see FIGS. 4A and 5). As with the base 146, the base 254 has a pair of substantially semi-cylindrical grooves 154*a* and 156*a*. With the cover 148 mated to the base 254, the grooves 154*a* and 158 cooperatively form a substantially cylindrical channel 162*a*, and the grooves 156*a* and 160 cooperatively form a substantially cylindrical channel 164*a* (see FIG. 2). Cylindrical channel 162*a* houses the main pivot shaft 166*a* for the pull handle 142. Cylindrical channel 164*a* of the pull-handle assembly houses locking rods 168*a* and 170*a* (see FIG. 28) which are mirror images of the locking rods 168 and 170.

The pull handle 142 is substantially cylindrical and is adapted for grasping by a person opening or closing the door 46. The pull handle 142 extends vertically between a top pivot arm 172*a* and a bottom pivot arm 174*a* (see FIGS. 3, 24, 26, and 27). The top and bottom pivot arms 172*a* and 174*a* are fixed to respective ends of the shaft 166*a*. The shaft 166*a* is attached to the top and bottom pivot arms 172*a* and 174*a* at the broad ends 178*a* and 180*a* of the top and bottom pivot arms 172*a* and 174*a*. The pull handle 142 extends between the narrow ends 182*a* and 184*a* of the top and bottom pivot arms 172*a* and 174*a*. The shaft 166*a* is rotatably supported within the cylindrical channel 162*a* in the same manner in which the shaft 166 is supported within the cylindrical channel 162. The shaft 166*a* is free to rotate relative to the collars 186*a* and 188*a* (see FIGS. 24 and 25) which are fixed to the base 254. It should be readily apparent from the above description that the assembly, including the pull handle 142, the top pivot arm 172*a*, the bottom pivot arm 174*a*, and the shaft 166*a*, will pivot as a rigid body about the longitudinal axis of the shaft 166*a* as the pull handle 142 is moved toward or away from the door 46.

Figure 26:
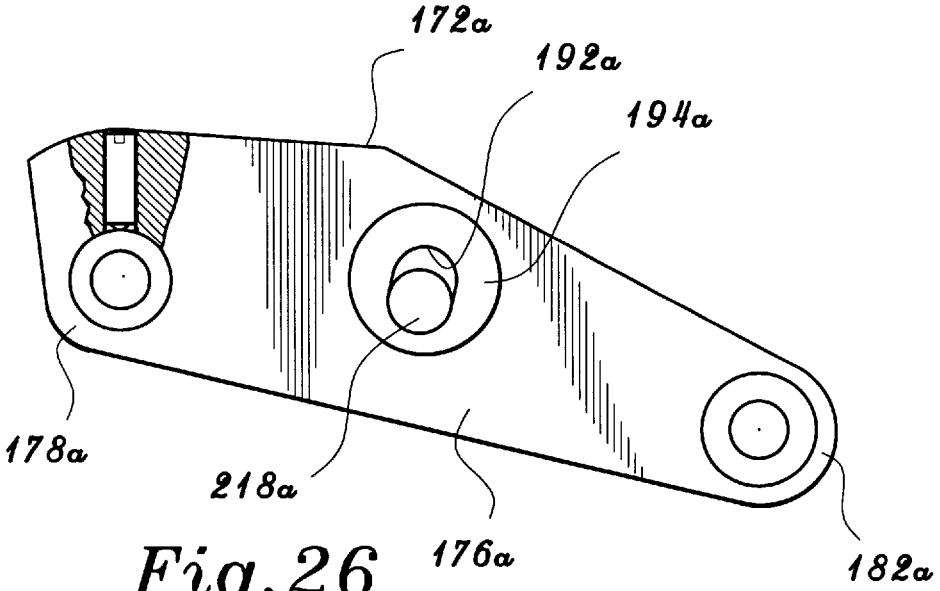
FIG. 26 shows the underside of the top pivoting member of the pull handle.
Figure 27:
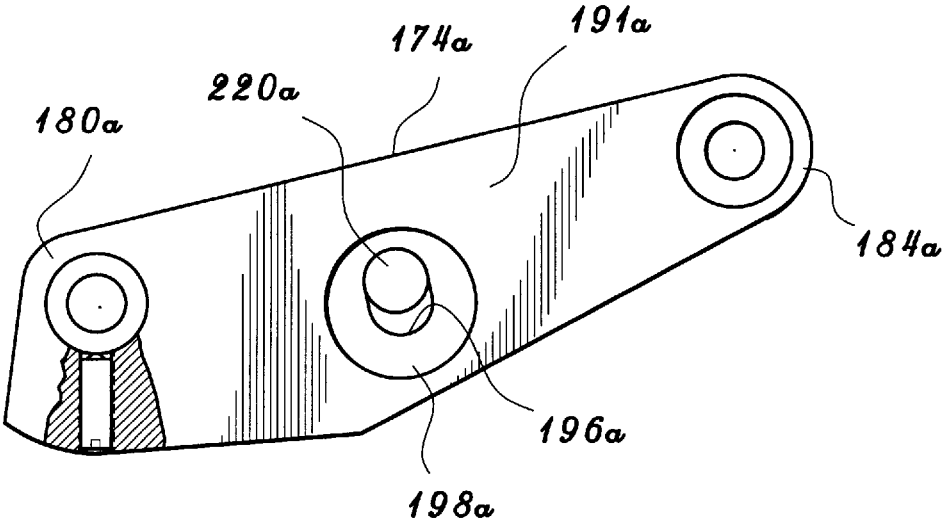
FIG. 27 shows the top side of the bottom pivoting member of the pull handle.

Referring to FIGS. 26 and 27, the bottom surface 176*a* of the top pivot arm 172*a* and the top surface 191*a* of the bottom pivot arm 174*a* can be seen. The bottom pivot arm 174*a* is a mirror image of the top pivot arm 172*a*. An arc shaped recess 192*a* is formed in an insert 194*a* which is embedded in the bottom surface 176*a* of the top pivot arm 172*a*. A similar arc shaped recesses 196*a* is formed in an insert 198*a* which is embedded in the top surface 191*a* of the bottom pivot arm 174*a*.

Figure 28:
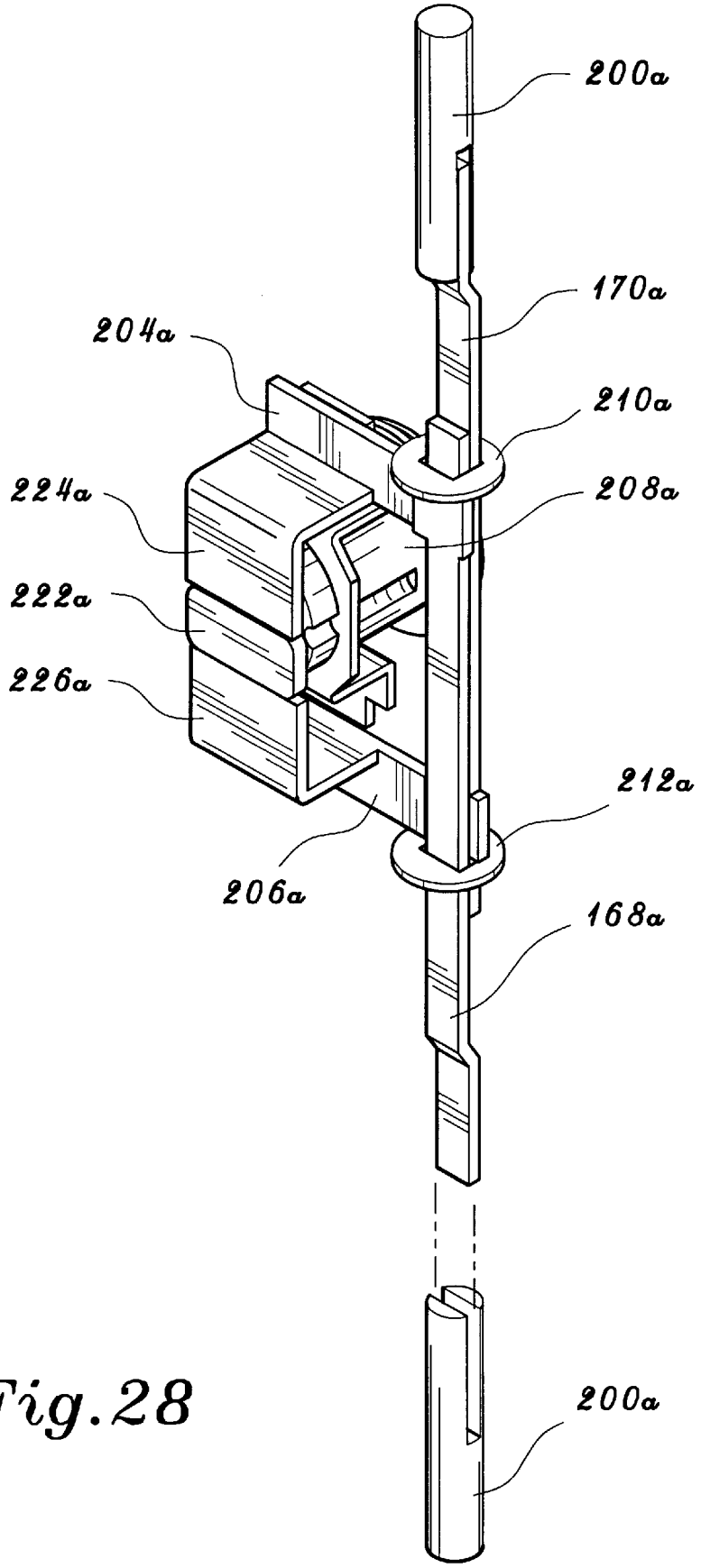
FIG. 28 is a rear perspective view showing the cylinder lock and the locking rods of the pull-handle assembly in isolation.

Referring to FIG. 28, each of the locking rods 168*a* and 170*a* has a cylindrical attachment 200*a* fixed thereto. The locking rods 168*a* and 170*a* and their associated cylindrical attachments 200*a* are supported within the cylindrical channel 164*a* in a manner similar to the manner in which the locking rod 168, the locking rod 170, and the cylindrical attachments 200 are supported within the cylindrical channel 164. The locking rods 168*a* and 170*a* have horizontal projections 204*a* and 206*a* respectively. The horizontal projection 204*a* is positioned above the cylinder lock 208*a* of the pull handle while the horizontal projection 206*a* is positioned below the cylinder lock 208*a*, such that a portion of the locking rod 170*a* overlaps a portion of the locking rod 168*a*. A washer 210*a* abuts the horizontal projection 204*a*. The locking rod 170*a* passes through the washer 210*a* and can reciprocate freely relative to the washer 210*a*. Similarly, a washer 212*a* abuts the horizontal projection 206*a*, and the locking rod 168*a* passes through the washer 212*a* and can reciprocate freely relative to the washer 212*a*.

The cylindrical attachment 200*a* of the locking rod 170*a* fits into the arc shaped recess 192*a*, while the cylindrical attachment 200*a* of the locking rod 168*a* fits into the arc shaped recess 196*a*. As with locking rods 168 and 170, coil springs (not shown) bias the cylindrical attachments 200*a* to project as deeply as possible into the arc shaped recesses 192*a* and 196*a*. The pull handle 142 can pivot between a locked position and an unlocked position. The pull handle 142 is farther from the door 46 in the unlocked position than it is in the locked position. The recesses 192*a* and 196*a* define the limits of movement of the pull handle 142. At the end of the recess 192*a*, farthest from the door 46, is a deeper portion 218*a*. Similarly, at the end of the recess 196*a*, farthest from the door 46, is a deeper portion 220*a* (see FIG. 27). When the pull handle 142 is in the locked position, the deeper portions 218*a* and 220*a* register with the cylindrical attachments 200*a*. The cylindrical attachments 200*a* move into the deeper portions 218*a* and 220*a* under spring pressure. With the cylindrical attachments 200*a* inserted into the deeper portions 218*a* and 220*a* of the recesses 192*a* and 196*a*, the pull handle 142 is locked in place and is prevented from pivoting.

To operate the pull handle 142 and effect the opening of the door 46, the appropriate key (not shown) must be inserted into the cylinder lock 208*a*. Normally the same key would open both locks 208 and 208*a*. Turning the key, and thus the cylinder lock 208*a*, turns the cam bar 222*a* (see FIG. 28) which is rigidly fixed to the cylinder lock 208*a*. As the cam bar 222*a* turns, brackets 224*a* and 226*a* are pushed apart. The bracket 224*a* is fixed to the horizontal projection 204*a* of the locking rod 168*a*, while the bracket 226*a* is fixed to the horizontal projection 206*a* of the locking rod 170*a*. It should be readily apparent that as the brackets 224*a* and 226*a* are pushed apart, the locking rod 168*a* is pulled up while the locking rod 170*a* is pulled down. The cylindrical attachments 200*a* being fixed to the locking rods 168*a* and 170*a*, the cylindrical attachments 200*a* will be withdrawn from the deeper portions 218*a* and 220*a* of the recesses 192*a* and 196*a* as the cylinder lock 208*a* is turned. Withdrawal of cylindrical attachments 200*a* from the deeper portions 218*a* and 220*a* allows the pull handle 142 to pivot to the unlocked position as the handle 142 is pulled by a user.

As the pull handle 142 pivots to the unlocked position, the shaft 166*a* is rotated. As was stated previously, the collars 186*a* and 188*a* remain stationary as the shaft 166*a* pivots. Each set of collars 186*a* and 188*a* has a spring rod 228*a* (see FIG. 24) extending therebetween, parallel to the shaft 166*a*. Viewing the shaft 166*a* from above, the shaft 166*a* rotates in a counter clockwise direction as the handle 142 moves to the unlocked position. A pair of pins 230*a* project perpendicularly from the shaft 166*a*. The pins 230*a* are located clockwise from the spring rods 228*a* and abut the spring rods 228*a* when the handle 142 is in the locked position. Therefore, the handle 142 can only be moved to the unlocked position if the spring rods 228*a* bend due to the action of the pins 230*a*. The spring rods 228*a* are sufficiently resilient such that they will bend without exceeding their elastic limit over the range of movement of the pins 230*a*. Further, the spring rods 228*a* will tend to return to their straight configuration once the handle 142 is released. Thus the spring rods 228*a* bias the handle 142 toward the locked position.

Located intermediate the two collars 188*a*, there are two collars 232*a*. The collars 232*a* are fixed to the shaft 166*a* and rotate therewith. Intermediate the collars 232*a*, is a collar 234*a* (see FIGS. 24 and 25). The collars 188*a*, 232*a*, and 234*a* are identical to the collars 188, 232, and 234 and function in exactly the same way. The collar 234*a* rotates responsive to the rotation of the shaft 166*a* through the use of the same motion amplification mechanism used in the push-handle assembly. This motion amplification mechanism uses actuating rods 236*a* which are identical to and function in exactly the same manner as the actuating rods 236. In the same manner as described for the push-handle assembly, the actuating rods 236*a* amplify the rotation of the shaft 166*a*, causing the collar 234*a* to rotate a greater amount for a given rotation of the shaft 166*a*.

Figure 25:
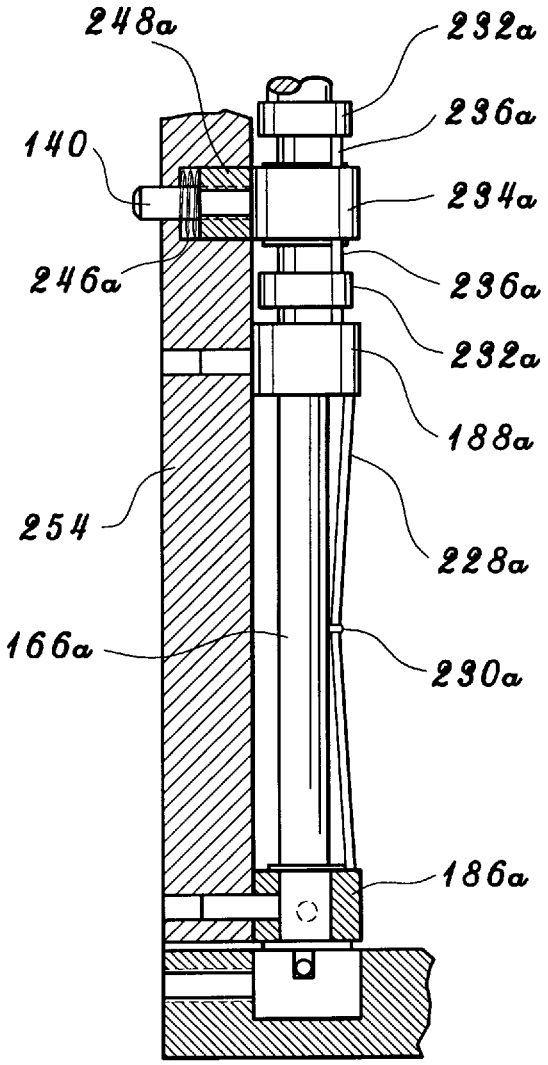
FIG. 25 is a fragmentary view showing the relationship of the pivot shaft of the pull handle with the pull-handle base.

Referring to FIG. 25, the collar 234*a* fits over a cavity 246*a*. The collar 234*a* has a flat, identical to the flat 244 of collar 234 (see FIG. 10), which is aligned with the cavity 246*a* when the handle 142 is in the locked position. The push pin 140 threadedly engages a sleeve 248*a* housed in the cavity 246*a*. The sleeve 248*a* is spring biased into abutting contact with the collar 234*a*. As the collar 234*a* rotates, the collar's flat (identical to item 244 in FIG. 10) comes out of alignment with the cavity 246*a* while the collar's arcuate surface (identical to item 252 in FIG. 10) moves into alignment with the cavity 246*a*. With the arcuate surface of the collar 234*a* in alignment with the cavity 246*a*, more of the collar 234*a* projects into the cavity 246*a* causing the sleeve 248*a* to be thrust deeper into the cavity 246*a* and thus causing the push pin 140 to be thrust farther outward from the base 254. Movement of the handle 142 from the locked position to the unlocked position, causes rotation of the shaft 166*a*. Rotation of the shaft 166*a* in turn causes the rotation of the collar 234*a* through the motion amplification mechanism described earlier. Rotation of the collar 234*a* causes the push pin 140 to thrust farther into the cavity 42. Thus movement of the handle 142 to the unlocked position causes the push pin 140 to thrust farther into the cavity 42 and push in the push pad 58. As was explained earlier, pushing in the push pad 58 causes the latch 56 to be withdrawn from the opening 116, which is necessary for opening the door 46.

Figure 22:
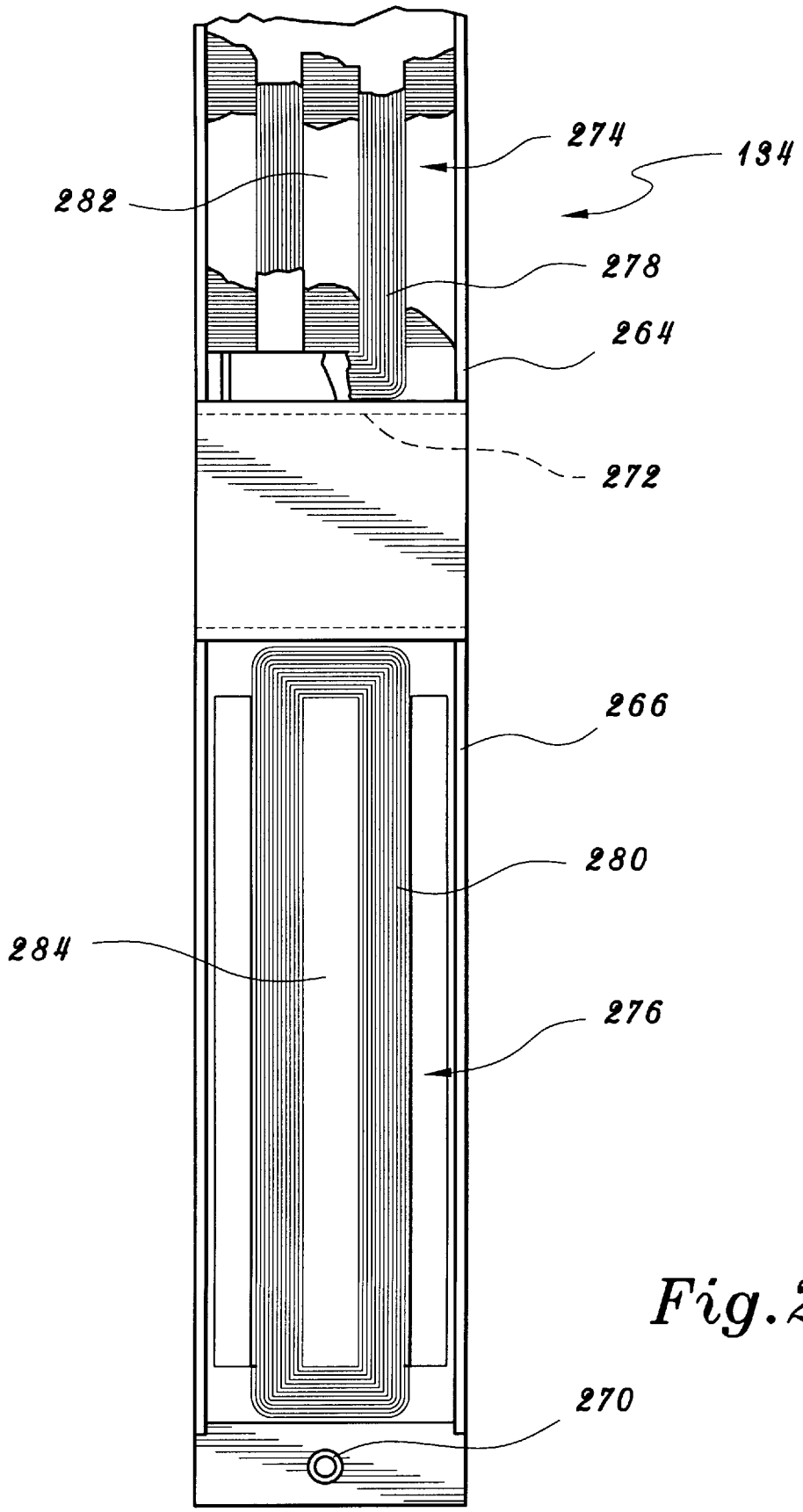
FIG. 22 is an elevational view of the electromagnet of the present invention partially broken away to show the structure of the magnetic coils and the electromagnet core.

Referring to FIGS. 2, 7, and 22, the electromagnet assembly 34 is mortised into the door frame 268, and is retained in place by fasteners such as screws (not shown) passing through eyelets 270. The electromagnet assembly 34 includes an electromagnet housing 134 having a cavity 272 which receives the latch 56 when the latch 56 is in the locked position. The cavity 272 also houses the latch pusher mechanism 40. Above and below the cavity 272 are compartments 264 and 266. The compartments 264 and 266 house electromagnets 274 and 276. Electromagnets 274 and 276 are composed of windings 278 and 280 wrapped around laminated cores 282 and 284, respectively. The circuitry energizing electromagnets 274 and 276 is conventional and is therefore not shown in the drawings. When the door 46 is locked the ferromagnetic cores 258 and 260 register with the electromagnets 274 and 276 respectively. The electromagnets 274 and 276 are normally energized, and the latch 56 is mechanically inserted into the cavity 272, when the door 46 is locked. Thus the electromagnetic lock of the present invention keeps the door 46 locked using the magnetic force exerted on the cores 258 and 260 by the electromagnets 274 and 276, and using the mechanical insertion of the latch 56 into the cavity 272. The lock is preferably designed such that the magnets 274 and 276 are so powerful that they can keep the door 46 locked without the help of latch 56. However, many local ordinances and building codes mandate the use of a mechanical latch. Therefore, the latch 56 has been incorporated into the electromagnetic lock of the present invention.

Figure 18:
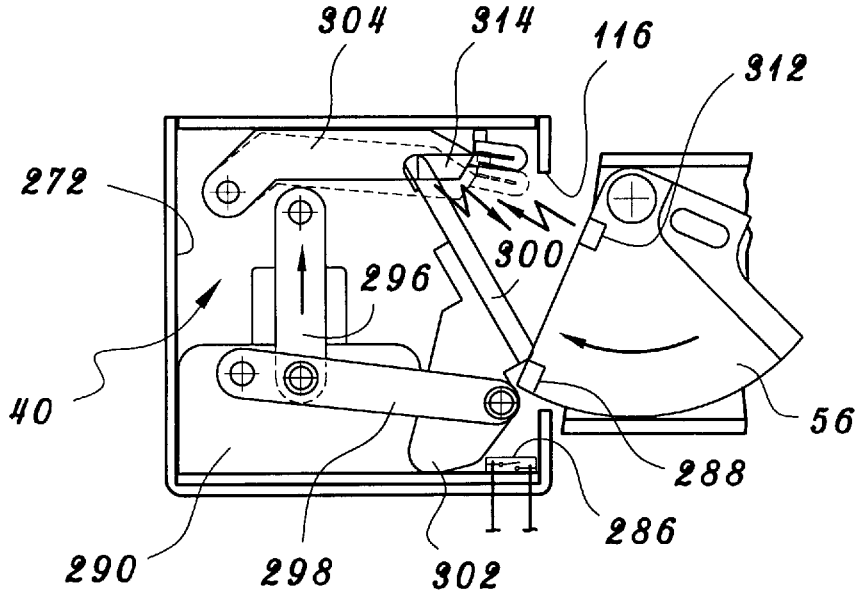
FIG. 18 is a bottom cross sectional view of the latch pusher mechanism of the electromechanical lock of the present invention, showing the latch pushing the pusher plate away from the latch receiving hole.

Referring to FIG. 18, a reed switch 286 is housed in the cavity 272. The reed switch 286 is affected by a magnet 288 embedded in the latch 56. When the latch 56 is at or near the open position, the magnet 288 is sufficiently close to the switch 286 to cause the switch 286 to change states from closed to open or visa versa. This change in state can be detected by the circuitry controlling the electromagnets 274 and 276. The control circuitry will then de-energize the electromagnets 274 and 276 to allow the door 46 to open. As the door 46 swings open the magnet 288 will again move far enough from the reed switch 286 to allow the reed switch 286 to return to its previous state. The return of the reed switch 286 to its previous state signals the control circuit to re-energize the electromagnets 274 and 276. At this time, the cores 258 and 260 will be far enough away from the electromagnets 274 and 276 so that the re-energizing of the electromagnets 274 and 276 will not impede the opening of the door 46. If necessary the control circuit can be designed to energize the electromagnets 274 and 276 after a predetermined delay to ensure that the opening of the door 46 will not be impeded inappropriately. As previously stated, building the control circuit mentioned above would be within the level of ordinary skill in the art and is therefore not described in detail herein.

The latch pusher mechanism 40 allows the door 46 to be opened remotely, either by a security guard or by a resident, to allow visitors who do not have keys through the door 46. Referring to FIGS. 2, 7, 15, and 16–21, the structure and function of the latch pusher mechanism 40 will be explained. The latch pusher mechanism 40 includes a solenoid 290, a solenoid plunger 292, a transfer bar 294, a pair of linkage bars 296, a pair of actuating arms 298, a pusher plate 300 having a pair of cam ears 302, a locking stirrup 304, and a locking stirrup pivot shaft 306. All the components of the latch pusher mechanism 40 are maintained in the proper spacial relationship relative to one another by the U-shaped cross section receiver 308. The locking stirrup 304 is pivotally supported by the locking stirrup pivot shaft 306. The transfer bar 294 is fixed to the solenoid plunger 292 such that the transfer bar 294 moves up and down with the solenoid plunger 292. Each of the actuating arms 298 is hingedly attached to the receiver 308 at one end, and hingedly attached to a respective cam ear 302 at the other end. Each of the linkage bars 296 is hingedly attached to the transfer bar 294 at one end, and hingedly attached to a respective actuating arm 298 at the other end. Each linkage bar 296 is attached to the respective actuating arm 298 intermediate the attachment points of the actuating arm 298 to the receiver 308 and to the respective cam ear 302. After the latch pusher mechanism 40 is fitted into the cavity 272, a plate 310 is fastened to the electromagnet housing 134 to act as a closure for the open side of the cavity 272 and to secure the latch pusher mechanism 40 within the cavity 272 (see FIG. 7).

Figure 16:
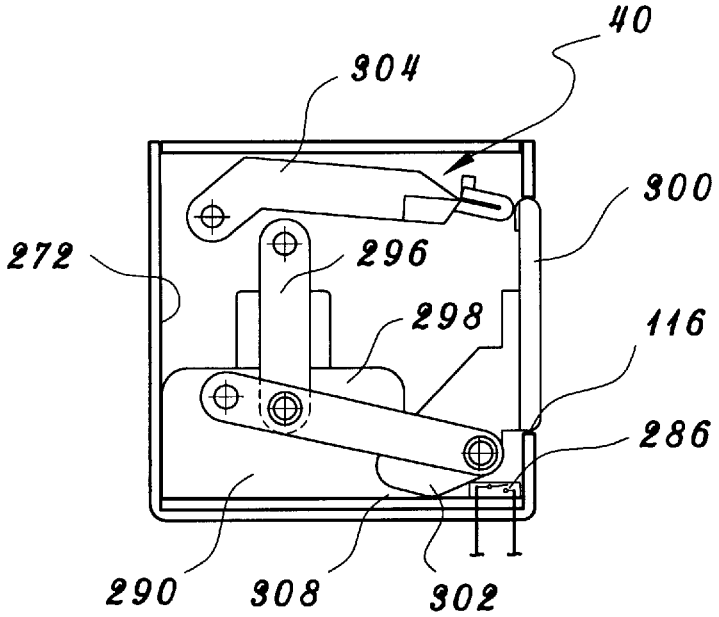
FIG. 16 is a bottom cross sectional view of the latch pusher mechanism of the electromechanical lock of the present invention, showing the pusher plate in position to block the latch receiving hole.

After the door 46 has been opened, the latch pusher mechanism 40 will be in the configuration illustrated in FIG. 16. In the configuration of FIG. 16, the solenoid 290 is not energized and the locking stirrup 304 is positioned behind the pusher plate 300 in order to block any movement of the pusher plate 300. Thus the pusher plate 300 is locked in place when the door 46 is open. Locking the pusher plate 300 in position so as to block the opening 116, when the door 46 is open, has several advantages. First, the lock cannot be kept open by stuffing foreign objects into the cavity 272, and second, vandals will not be able to access and damage the latch pusher mechanism 40.

Figure 17:
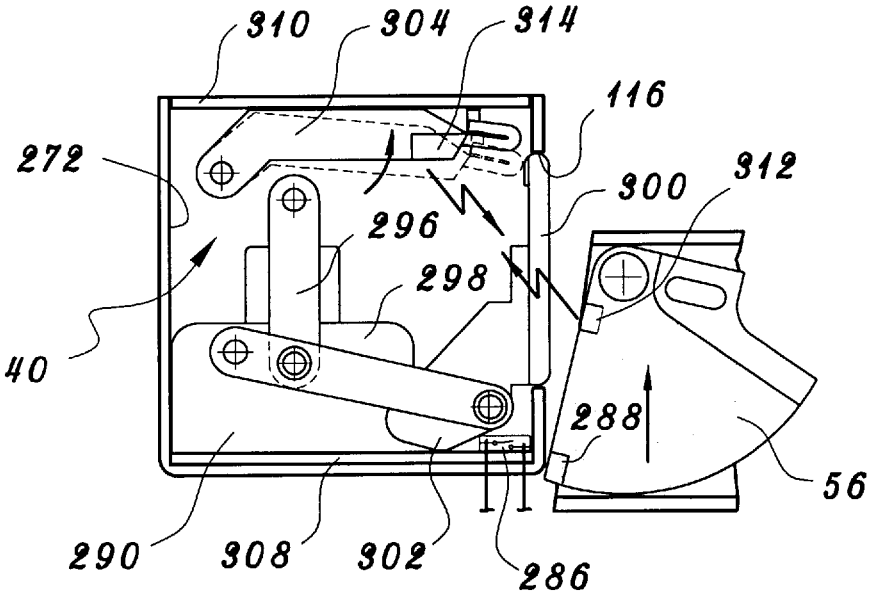
FIG. 17 is a bottom cross sectional view of the latch pusher mechanism of the electromechanical lock of the present invention, showing the latch approaching the latch receiving hole.
Figure 19:
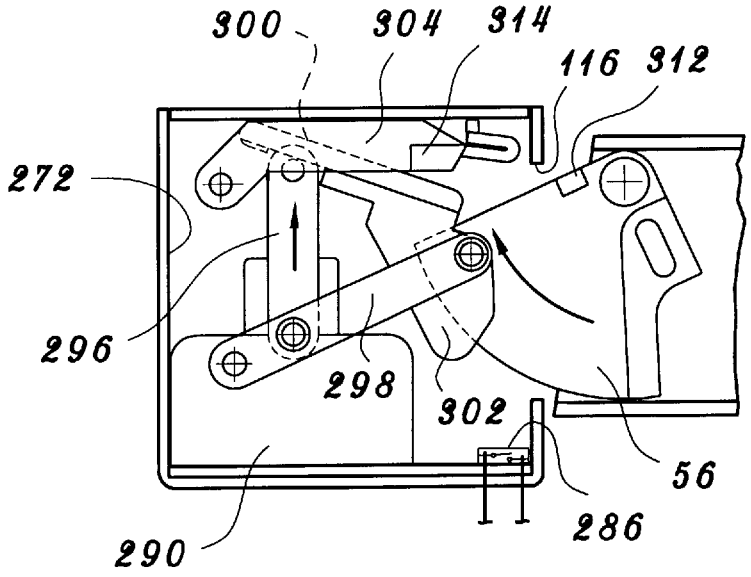
FIG. 19 is a bottom cross sectional view of the latch pusher mechanism of the electromechanical lock of the present invention, showing the latch inserted into the latch receiving hole.

FIG. 17 shows the sequence of events as the door is being closed. As the latch 56 approaches the pusher plate 300, the magnet 312, embedded in the latch 56, repels the magnet 314 carried by the locking stirrup 304 and thereby moves the locking stirrup 304 out from behind the pusher plate 300. The pusher plate 300 can now be moved out of opening 116 freely. Referring to FIGS. 18 and 19, as the latch 56 moves into registry with the opening 166, the latch 56 pushes the pusher plate 300 out of the opening 116 and becomes inserted into the cavity 272 under the force of the torsion spring 76 (shown in FIG. 14DB). The door 46 is now locked. As the pusher plate 300 moves away from the opening 116, the actuating arms 298 are caused to pivot and the plunger 292 is caused to extend farther outward from the solenoid 290.

Figure 20:
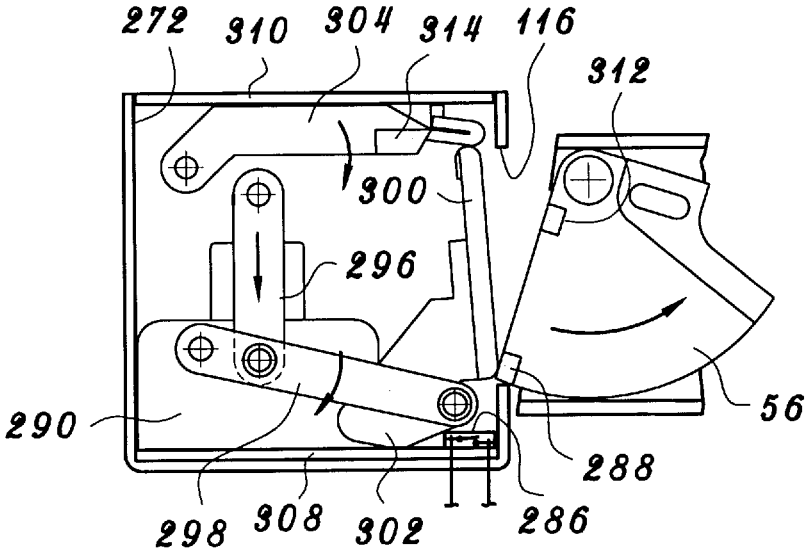
FIG. 20 is a bottom-cross sectional view of the latch pusher mechanism of the electromechanical lock of the present invention, showing the pusher plate pushing the latch out of the latch receiving hole.
Figure 21:
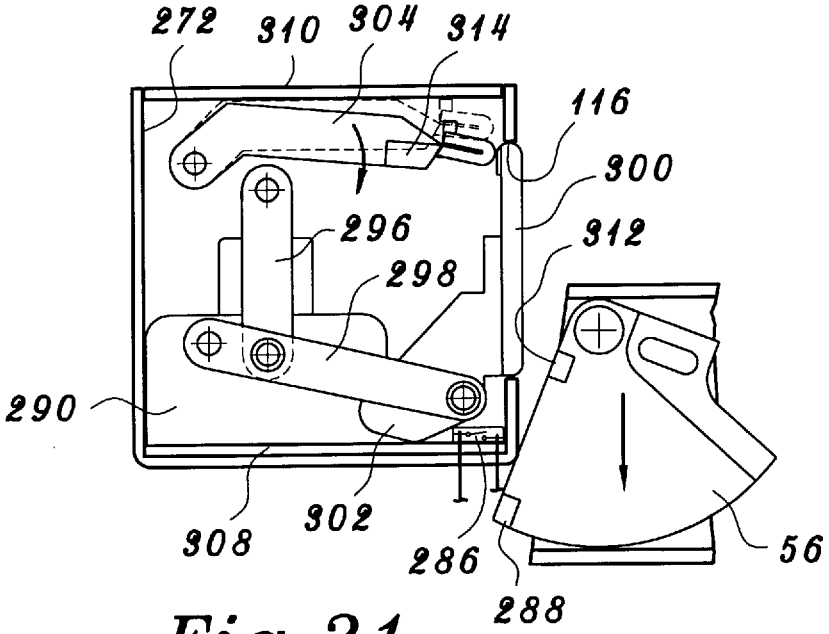
FIG. 21 is a bottom cross sectional view of the latch pusher mechanism of the electromechanical lock of the present invention, showing the latch being moved away from the latch receiving hole.

Referring to FIGS. 20 and 21, to remotely open the door 46 the solenoid 290 is energized. Energizing the solenoid 290 causes the solenoid plunger 292 to be retracted farther into the solenoid 290 and the transfer bar 294 to be moved closer to the solenoid 290. The movement of the transfer bar is transmitted to the actuating arms 298 by the linkage bars 296 and causes the actuating arms 298 to pivot toward the surface supporting the solenoid 290. As the actuating arms 298 pivot, the cam ears 302 will forcefully hit the surface supporting the solenoid 290. The force exerted by the surface supporting the solenoid 290 on the cam ears 302 and the force exerted by the actuating arms 298, impart a moment to the pusher plate 300 causing the pusher plate 300 to rotate about the attachment points between the actuating arms 298 and their respective cam ears 302. As the pusher plate 300 is rotated the latch 56 is pushed out of the cavity 272 and the opening 116 is eventually blocked by the pusher plate 300. As previously described, the magnet 288 will cause the reed switch 286 to change state at about this time, which in turn leads to the electromagnets 274 and 276 being de-energized. The door 46 is now unlocked and can be opened. The locking stirrup 304 has a natural tendency, due to the affinity of the magnet 314 for the ferrous objects within cavity 272, to move in behind the pusher plate 300 thereby locking the pusher plate 300 in place. Alternatively, the locking stirrup 304 may be spring biased to move in behind the pusher plate 300 when the pusher plate 300 is blocking the opening 116.

When a person without a key wishes to enter or exit a building equipped with the lock of the present invention, he or she must first contact a building occupant such as a tenant or security guard. This can be accomplished using well known means such as an intercom or a surveillance camera. Once the determination is made that the person can be permitted to enter or exit the building, the solenoid 290 can be energized by the tenant or security guard using well known means (not shown), thus allowing the visitor to enter the building.

The construction of the present invention can be simplified when it is desired to allow keyless exit from the building. In such a case the lock cylinder and the locking rods need only be provided on the outside, i.e. the pull-handle side of the door 46 in the illustrated example.

Although the lock of the present invention has been described in the context of an entry door which opens out of the building, it should readily be apparent to those of ordinary skill in the art that the lock of the present invention can easily be adapted for application to doors that open into the building. In such cases, the pull handle would be on the inside and the push handle would be on the outside of the door.

In addition, it is possible to incorporate the electromagnets in the door and fix the magnetic cores to the door frame. Another alternative design is to provide only one locking rod for each of the push-handle and the pull-handle assemblies, whereby the handles are locked in place by a single cylindrical attachment 200 or 200*a* moving into respective recess in the top or bottom cross member of each handle. All such variations are contemplated as being within the scope of the present invention.

It is to be understood that the present invention is not limited to the sole embodiment described above, but encompasses any and all embodiments within the scope of the following claims. Note that in the appended claims the term locking rod is used generically and encompasses the assembly formed by any of the locking rods 168, 170, 168*a*, and 170*a* and its associated cylindrical attachment 200 or 200*a*. Further, the term recess is used generically in the appended claims and is understood to encompass the deeper portions of the recesses 192, 196, 192*a*, and 196*a*.

I claim:

1. An electromagnetic door locking system for use with a door engageable with a door frame, the door being movable between a closed position in which the door is in mating engagement with the door frame and an open position in which the door is out of mating engagement with the door frame, said electromagnetic door locking system comprising:

a latch movable between a locked position and an unlocked position, said latch engagable with a cavity of the door frame when said latch is in said locked position;

a first ferromagnetic core adapted to be fixed to the door, said first ferromagnetic core overlying a first portion of the door frame when the door is closed;

a first electromagnet adapted to be fixed to the door frame, said first electromagnet being in registry with said first ferromagnetic core when the door is closed, said first electromagnet exerting a force on said first ferromagnetic core to maintain the door in the closed position when said first electromagnet is energized; and a solenoid operably linked to a pusher plate adapted to be disposed within the cavity, whereby said latch is pushed out of the cavity by said pusher plate when said solenoid is energized.

2. The electromagnetic door locking system according to claim 1, further including:

a pull handle mechanically linked to said latch, said pull handle moving said latch into said unlocked position when said pull handle is pivoted away from the door.

3. The electromagnetic door locking system according to claim 2, wherein said pull handle has a recess therein, said electromagnetic door locking system further including:

a first locking rod engageable with said recess in said pull handle, said first locking rod being spring biased to engage said recess in said pull handle, said first locking rod preventing said pull handle from pivoting away from the door when said first locking rod is in engagement with said recess in said pull handle.

4. The electromagnetic door locking system according to claim 3, further including:

a first cylinder lock turnable by a key, said first cylinder lock being capable of mechanically acting on said first locking rod to move said first locking rod out of engagement with said recess in said pull handle when said first cylinder lock is turned.

5. The electromagnetic door locking system according to claim 4, further including:

means for de-energizing said first electromagnet, said means for de-energizing said first electromagnet operating to de-energize said first electromagnet responsive to said latch moving to said unlocked position.

6. The electromagnetic door locking system according to claim 5, wherein said means for de-energizing said first electromagnet includes a reed switch.

7. The electromagnetic door locking system according to claim 6, further including:

a push handle mechanically linked to said latch, said push handle moving said latch into said unlocked position when said push handle is pivoted toward the door.

8. The electromagnetic door locking system according to claim 7, wherein said push handle has a recess therein, said electromagnetic door locking system further including:

a second locking rod engageable with said recess in said push handle, said second locking rod being spring biased to engage said recess in said push handle, said second locking rod preventing said push handle from pivoting toward the door when said second locking rod is in engagement with said recess in said push handle.

9. The electromagnetic door locking system according to claim 8, further including:

a second cylinder lock turnable by a key, said second cylinder lock being capable of mechanically acting upon said second locking rod to move said second locking rod out of engagement with said recess in said push handle when said second cylinder lock is turned.

10. An electromagnetic door locking system for use with a door engageable with a door frame, the door being movable between a closed position in which the door is in mating engagement with the door frame and an open position in which the door is out of mating engagement with the door frame, said electromagnetic door locking system comprising:

a latch movable between a locked position and an unlocked position, said latch engagable with a cavity of the door frame when said latch is in said locked position;

a first ferromagnetic core adapted to be fixed to the door, said first ferromagnetic core overlying a first portion of the door frame when the door is closed;

a first electromagnet adapted to be fixed to the door frame, said first electromagnet being in registry with said first ferromagnetic core when the door is closed, said first electromagnet exerting a force on said first ferromagnetic core to maintain the door in the closed position when said first electromagnet is energized;

a second ferromagnetic core adapted to be fixed to the door, said second ferromagnetic core overlying a second portion of the door frame when the door is closed;

a second electromagnet adapted to be fixed to the door frame, said second electromagnet being in registry with said second ferromagnetic core when the door is closed, said second electromagnet exerting a force on said second ferromagnetic core to maintain the door in the closed position when said second electromagnet is energized; and a solenoid operably linked to a pusher plate adapted to be disposed within said cavity, whereby said latch is pushed out of said cavity by said pusher plate when said solenoid is energized.

11. The electromagnetic door locking system according to claim 10, wherein said first electromagnet and said second electromagnet are adapted to be recessed into the door frame above and below said cavity, respectively.

12. The electromagnetic door locking system according to claim 10, further including:

a pull handle mechanically linked to said latch, said pull handle moving said latch into said unlocked position when said pull handle is pivoted away from the door.

13. The electromagnetic door locking system according to claim 12, wherein said pull handle has a recess therein, said electromagnetic door locking system further including:

a first locking rod engageable with said recess in said pull handle, said first locking rod being spring biased to engage said recess in said pull handle, said first locking rod preventing said pull handle from pivoting away from the door when said first locking rod is in engagement with said recess in said pull handle.

14. The electromagnetic door locking system according to claim 13, further including:

a first cylinder lock turnable by a key, said first cylinder lock being capable of mechanically acting on said first locking rod to move said first locking rod out of engagement with said recess in said pull handle when said first cylinder lock is turned.

15. The electromagnetic door locking system according to claim 14, further including:

means for de-energizing said first electromagnet and said second electromagnet, said means for de-energizing said first electromagnet and said second electromagnet de-energizing said first electromagnet and said second electromagnet in response to said latch moving to said unlocked position.

16. The electromagnetic door locking system according to claim 15, wherein said means for de-energizing said first electromagnet and said second electromagnet includes a reed switch.

17. The electromagnetic door locking system according to claim 16, further including:

a push handle mechanically linked to said latch, said push handle moving said latch into said unlocked position when said push handle is pivoted toward the door.

18. The electromagnetic door locking system according to claim 17, wherein said push handle has a recess therein, said electromagnetic door locking system further including:

a second locking rod engageable with said recess in said push handle, said second locking rod being spring biased to engage said recess in said push handle, said second locking rod preventing said push handle from pivoting toward the door when said second locking rod is in engagement with said recess in said push handle.

19. The electromagnetic door locking system according to claim 18, further including:

a second cylinder lock turnable by a key, said second cylinder lock being capable of mechanically acting upon said second locking rod to move said second locking rod out of engagement with said recess in said push handle when said second cylinder lock is turned.

* * * * *